US006546973B2

(12) United States Patent
Hattori et al.

(10) Patent No.: US 6,546,973 B2
(45) Date of Patent: Apr. 15, 2003

(54) EQUIPMENT FOR FILLING FLEXIBLE CONTAINER WITH VISCOUS MATERIAL.

(75) Inventors: Eiji Hattori, Kyoto (JP); Masaaki Murase, Kofu (JP); Kiyoshi Nakayama, Yamanashi (JP); Osamu Yazaki, Yamanashi (JP)

(73) Assignee: Sunstar Engineering Inc., Takatsuki (JP)

( * ) Notice: Subject to any disclaimer, the term of this patent is extended or adjusted under 35 U.S.C. 154(b) by 0 days.

(21) Appl. No.: 10/216,231

(22) Filed: Aug. 12, 2002

(65) Prior Publication Data

US 2002/0195166 A1 Dec. 26, 2002

Related U.S. Application Data

(62) Division of application No. 09/762,543, filed as application No. PCT/JP99/00610 on Jan. 12, 1999, now Pat. No. 6,463, 968.

(30) Foreign Application Priority Data

Aug. 11, 1998 (JP) ..... 10-226961
Dec. 16, 1998 (JP) ..... 10-357754

(51) Int. Cl.[7] ..... B65D 7/14

(52) U.S. Cl. ..... 141/372; 141/77; 141/114; 141/260; 141/263; 141/374; 53/289; 53/469

(58) Field of Search ..... 141/1, 77, 80, 141/145, 165, 146, 168, 172, 178, 252, 253, 258, 260, 263, 269, 270, 369, 372, 374, 129; 53/289, 469

(56) References Cited

U.S. PATENT DOCUMENTS 3,295,293 A 1/1967 Lodding
3,491,803 A 1/1970 Galik
3,531,908 A 10/1970 Rausing et al.
3,674,060 A 7/1972 Ruekberg
5,353,850 A * 10/1994 Ueda et al. ..... 141/129
5,533,324 A * 7/1996 Furukawa et al. ..... 53/469
5,975,158 A 11/1999 Gordon et al.

FOREIGN PATENT DOCUMENTS

| | | |
|---|---|---|
| JP | 56-23843 | 6/1981 |
| JP | 56-68606 | 6/1981 |
| JP | 57-193607 | 11/1982 |
| JP | 58-73760 | 5/1983 |
| JP | 58-125406 | 7/1983 |
| JP | 63-186699 | 11/1988 |
| JP | 2-98504 | 4/1990 |
| JP | 4-112002 | 9/1992 |
| JP | 6-239304 | 8/1994 |
| JP | 7-10126 | 1/1995 |
| JP | 7-503929 | 4/1995 |
| JP | 57-117335 | 4/1995 |
| JP | 7-171461 | 7/1995 |
| JP | 7-205999 | 8/1995 |

* cited by examiner

*Primary Examiner*—J. Casimer Jacyna
(74) *Attorney, Agent, or Firm*—Armstrong, Westerman & Hattori, LLP

(57) ABSTRACT

The present invention is a system for filling a container main body at least whose drum body is made of a flexible film, with a viscous material. A viscous material is charged by the charging means into container main bodies conveyed by the container conveying means, the drum body of the container main body is pressed by the pressing means to cause the surface of the viscous material to bulge, and the opening of the reinforcing component of the container main body is capped by the capping means, allowing the opening to be capped in an air-tight manner with a lid member while virtually all of the air inside the container main body is evacuated, and preventing air from being left over in the container main body so as to prevent hardening, curing and deterioration in the quality of the viscous material that can be caused by such remaining air.

3 Claims, 18 Drawing Sheets

EQUIPMENT FOR FILLING FLEXIBLE CONTAINER WITH VISCOUS MATERIAL.

This is a division of Ser. No. 09/762,543 filed Feb. 9, 2001 now U.S. Pat. No. 6,463,968 which was filed as PCT/JP99/00610 filed Jan. 12, 1999.

BACKGROUND OF THE INVENTION

1. Field of the Invention

The present invention relates to a system for filling flexible containers with viscous materials such as construction sealant or adhesives; a system for conveying cylindrical members as flexible containers; and a system for filling them with a viscous material; a method for filling flexible containers with a viscous material; and equipment for filling them with a viscous material; and a container filled with a viscous material.

2. Description of the Related Art

Widely used containers filled with construction sealant, such as the filled container 100 illustrated in FIG. 23, comprise a hard cylindrical container main body 103 with an open proximal end, a discharge hole 102 for discharging the sealant 101 formed at the distal end, and a plunger 104 fitted into the proximal opening. In such a filled container 100, the sealing lid member 105 for sealing the discharge hole 102 is opened, the virgin film 106 is then cut, a nozzle not shown in the figure is then mounted on the discharge hole 102, the container is then mounted in a special discharge gun, and the lever of the discharge gun is operated to move the plunger 104 gradually toward the inside distal end of the container main body 103, thereby allowing the sealant 101 to be extruded and discharged.

Means widely used as a method for filling this type of container main body 103 with the sealant 101 comprise vertically holding the container main body 103, usually with the proximal end on top, filling the container in this state with a fixed amount of sealant 101 in such a way as to prevent air bubbles from being mixed in through the proximal end opening, then forcibly evacuating the air between the plunger 104 and sealant 101 out through the sliding component between the container main body 103 and plunger 104 as the plunger 104 is inserted into the container main body 103 and against the sealant 101 in such a way that no air is left over.

Filled containers 100 with this type of structure are widely used at present because the air between the plunger 104 and sealant 101 can be almost completely evacuated, and the air-tightness between the plunger 104 and the container main body 103 can be satisfactorily preserved, but since the container main body 103 is hard, the filled container 100 cannot be squeezed to a smaller size after use, and is thus limited in terms of volume reduction, resulting in the problem of bulky waste.

Japanese Unexamined Patent Application (Kokai) 7-171461 proposed a flexible container in which the intermediate drum portion of the container main body was made of a flexible film, and a relatively hard upper molded part and bottom molded part were integrally formed with the distal and proximal ends of the container main body. This flexible container is mounted on the outer tube of a discharge gun, and the bottom molded part is moved toward the upper molded part side, so that the sealant is extruded and discharged from the discharge hole formed in the upper molded part as the intermediate drum component is squeezed, thereby allowing the flexible container to be squeezed into a smaller size after use to reduce the volume of waste.

The method described for filling the container with the sealant in this publication was a filling method in which the sealant was charged into the container main body through the opening of the bottom molded part formed in the shape of a ring, and the opening was then closed off in an air-tight manner after the material had been charged therein.

With hard cylindrical container main body 103 such as the aforementioned filled container 100, the container main body can be positioned perpendicular to the direction of conveyance on a conveyor to be transported from the molding equipment to the filling equipment, but flexible container main bodies such as that described in the aforementioned publication, in which the intermediate drum portion is made of a flexible film, are sometimes deformed while conveyed when transported by a similar conveying means, and there is thus a need for a conveying system capable of efficiently conveying such container main bodies.

Although the sealant is discharged from the flexible container described in the above publication as the container main body is squeezed, allowing the volume of the container to thus be reduced after use, the following problems nevertheless occur.

That is, it is possible to fit the lid member and bottom molded part together and fix them in an air-tight manner by means of an annular lock fitting component, for example, to improve the air-tightness between the bottom molded part and the lid member, but when such a structure is used, the position in which the lid member is fixed to the bottom molded part is fixed, so that when the amount of sealant charged into the container main body is not precisely established, there are problems in that air remains in the flexible container, causing the sealant to harden or to cure in the flexible container when a small amount of sealant has been charged in, whereas the sealant leaks out when the container is capped with the lid member when larger amounts of material have been charged in. Even if the container is filled with more precise amounts, when the lid member is fitted in an air-tight manner to the container main body, the air must be completely evacuated from between the container main body and the lid member, but it is difficult to thus fit the lid member in such a way as to leave no air.

The inventors took note of the fact that, when container main bodies were filled with larger amounts of sealant, virtually all the air was evacuated from between the container main body and the lid member even though excess sealant leaked out, and they discovered that virtually all of the air can be evacuated from between the container main body and the lid member when the lid member is fitted by pressing the container main body midway in the longitudinal direction while it is filled with sealant so as to cause the surface of the sealant to bulge in the container main body and thereby increase the apparent amount of sealant charged therein.

SUMMARY OF THE INVENTION

The filling system comprises container conveying means for conveying a container main body of which at least the drum body is made of a flexible film, charging means for charging a viscous material into the container main body, pressing means for pressing the drum body of the container main body to cause the surface of the viscous material to bulge, and capping means for capping the opening of the reinforcing component of the container main body with a lid member.

In this filling system, a viscous material is charged by the charging means into the container main bodies conveyed by the container conveying means, the drum body of the container main body is pressed by the pressing means to cause the surface of the viscous material to bulge, and the opening of the reinforcing component of the container main body is capped with a lid member by the capping means.

More specifically, when the viscous material is charged by the charging means into the container main body, the surface of the viscous material forms a peak with the center swelling up. Thus, when the drum body of the container main body is pressed to cause the surface of the viscous material in this state to bulge, the surface of the viscous material bulges while generally retaining a peaked shape when the viscous material has been charged in. In other words, the drum body is pressed to increase the apparent amount of the viscous material charged into the container main body. Since the opening of the reinforcing component of the container main body is capped with the lid member while the surface of the viscous material is thus bulging outward, the lid member first fits closely to the apex of the surface of the viscous material, the tight fit between the surface of the viscous material and the lid member spreads outward as the apex of the surface of the viscous material is then flattened out, and the lid member is then fitted to the opening as the drum body of the container main body returns to its original shape, resulting in the elimination of any gap between the surface of the viscous material and the lid member, so that virtually all the air in the container main body is evacuated, and the opening is capped in an air-tight manner.

The filling system is a filling system wherein the container conveying means comprises a carrying box for holding and conveying a plurality of container main bodies, the interior of the carrying box being divided, by means of dividing plates arranged in the form of a lattice, into a plurality of housing components with open fronts, allowing the container main bodies to be placed in and removed from the housing components. In this filling system, the container main bodies are conveyed while temporarily accommodated in the carrying box, thus effectively preventing the container main bodies from being damaged as they are being conveyed. As such, it becomes possible to ensure that deformation or the like is prevented during transport, even when the container main bodies have a drum body made of a flexible film.

The filling system in claim 3 is a filling system according to claim 2, wherein the carrying box that is used is such that a notch having a notch width which narrows in the depthwise direction is formed in the region including generally the center in at least the widthwise direction of the end on the open side of the dividing plates forming the housing components. With the use of a carrying box having such a structure, when a container main body is placed in a housing component of the carrying box, the end of the container main body on the side where it is inserted is guided by the notch, even when the axis of the container main body is somewhat off center relative to the axis of the housing component, so that the container main body is smoothly accommodated by the housing component. As a result, the end of the container main body is caught by the end of the housing component on the open side of the dividing sheet, preventing the inconvenience of ruptured container main bodies.

The filling system is a filling system wherein housing components are formed by a plurality of the dividing plates at rows and columns in the carrying box. As the carrying box constructed in this structure is moved 1 row or 1 column at a time, container main bodies can be placed in a plurality of housing components in each row or column of the carrying box, or container main bodies which have been placed in a plurality of housing components in each row or column of the carrying box can be simultaneously taken out, thereby allowing the container main bodies to be placed in and taken out of the carrying box.

The filling system is a filling system wherein the drum body of the container main body is temporarily pressed and then released by the capping means, and the lid member is fitted to the opening of the reinforcing component of the container main body as the drum body returns to its original shape after being released. With this type of structure, the drum body of the container main body is allowed to naturally return to its original shape in conjunction with the action of the lid member being fitted to the opening of the reinforcing component of the container main body, the lid member is fitted to the opening without leaving any air, and the container main body is capped in an air-tight manner.

The filling system is a filling system wherein, in order to allow the viscous material to be charged into the container main body by the charging means, a viscous material feed tube is first inserted into the interior of the container main body, and the viscous material is discharged from the viscous material feed tube to charge the viscous material into the container main body as the viscous material feed tube is moved in a direction away from the container main body. In this case, the viscous material can be charged synchronously with the relative movement between the container main body and the viscous material feed tube, effectively preventing air from being mixed into the viscous material or air from being left over between the container main body and the viscous material.

The system for conveying cylindrical members comprises a carrying box, the interior of which is divided, by means of dividing plates arranged in the form of a lattice, into a plurality of housing components with open fronts, allowing the cylindrical members to be placed in and removed from the housing components as the container main bodies; packing equipment for packing the cylindrical members into the housing components of the carrying box; and conveying means for conveying the carrying box.

In this conveying system, the cylindrical members serving as the container main bodies are conveyed while temporarily accommodated in the carrying box, allowing the cylindrical members to be effectively prevented from being damaged during transport. As such, they can be reliably prevented from deforming or the like during transport, even when the cylindrical members have drum bodies made of flexible film.

The conveying system is a conveying system wherein the carrying box that is used is such that a notch having a notch width which narrows in the depthwise direction is formed in the region including generally the center in at least the widthwise direction of the end on the open side of the dividing plates forming the housing components. With the use of a carrying box having such a structure, when a cylindrical member is placed in a housing component of the carrying box, the end of the cylindrical member on the side where it is inserted is guided by the notch, even when the axis of the cylindrical member is somewhat off center relative to the axis of the housing component, so that the cylindrical member is smoothly accommodated by the housing component. As a result, the end of the cylindrical member is caught by the end of the housing component on the open side of the dividing sheet, preventing the inconvenience of ruptured cylindrical members.

The conveying system is a conveying system wherein the housing components are formed by a plurality of the dividing plates at rows and columns in the carrying box, and the cylindrical members are packed into the plurality of housing components in each of the rows or columns of the carrying box as the carrying box is moved one row or column at a time. This structure allows cylindrical members to be efficiently packed in the housing components of the carrying box.

The conveying system is a conveying system further comprising transfer equipment for taking the cylindrical members out of the carrying box and transferring them. Such transfer equipment can be provided to automate the conveyance and transfer of the cylindrical members.

The conveying system is a conveying system wherein the transfer equipment further comprises an expanding head capable of expanding wider than the inside diameter of the cylindrical member and of holding the cylindrical member from the inside. Such a structure allows the cylindrical members to be held from the inside by the expanding head and transferred to the next step, thereby minimizing positional displacement of the cylindrical members during transfer.

The conveying system is a conveying system wherein the cylindrical members are taken out of the housing components by the transfer equipment and are transferred while vertically oriented. Providing such transfer equipment allows the orientation of the cylindrical members to be switched to a more readily manipulated orientation, thereby allowing various operations such as filling containers with the viscous material or processing to be carried out more efficiently. Specifically, a viscous material can be charged into container main bodies in the form of cylindrical members, and the container main bodies can be efficiently supplied to the filling equipment for capping.

The viscous material filling system is a viscous material filling system in which the cylindrical member that is used comprises using a container main body with at least the drum component consisting of a flexible film and the open end consisting of a rigid reinforcing component, and the container main body is filled with a viscous material and is capped with a lid member, wherein this viscous material filling system comprises: a conveying system for placing the container main bodies in the carrying box to convey them; and filling equipment for charging the viscous material into the container main bodies while the container main bodies being conveyed by the conveying system are supported vertically with the reinforcing component on the top, and for capping the reinforcing component of the container main body with a lid member.

In this filling system, the drum bodies of the container main bodies of the cylindrical members are made of a flexible film, but since the container main bodies are conveyed in the carrying box, it is possible to prevent inconveniences such as deformation of, or damage to, the drum bodies of the container main bodies during transport.

It is also possible to automate the transport of the container main bodies and the series of operations for charging the viscous material into the container main bodies and capping the container main bodies with lid members, and it is also possible to more efficiently fill the containers with the viscous material.

The viscous material filling system is one in which the cylindrical member that is used comprises using a container main body with at least the drum component body consisting of a flexible film and the open end consisting of a rigid reinforcing component, and the container main body is filled with a viscous material and is capped with a lid member, wherein the viscous material filling system comprises: a conveying system for conveying the container main bodies in the carrying box, the container main bodies being taken out of the carrying box by the transfer equipment and transferred while vertically oriented with the reinforcing component on top; and filling equipment comprising charging equipment and capping equipment for charging a viscous material into container main bodies transferred by the transfer equipment of the conveying system and for capping the reinforcing component with a lid member.

This filling system allows the drum body of the container main body to be prevented from being damaged or deformed, and also enables automation of the transport of the container main bodies and the series of operations for charging the viscous material into the container main body and capping the container main bodies with lid members. In addition, the container main bodies conveyed by the carrying box are transferred to the filling equipment while vertically oriented by the transfer equipment in this conveying system, so that the viscous material can be charged by the filling equipment into the container main bodies in the vertical orientation in which they are transferred, and the container main body can be capped with lid members, resulting in the smoother transfer of the container main bodies. The container main bodies can be transferred while held at the reinforcement component by the transfer equipment, making it possible to prevent inconveniences such as deformation of, or damage to, the drum body of the container main body during transport.

The filling system is a filling system having filling equipment further comprising transport means with support means for holding the reinforcement component of the container main body from the outside by means of a clamper to support the container main body, the support means being provided around the outside of a rotating table, and the container main bodies being sequentially transported by the transport means in the filling equipment, filled with viscous material, and capped with lid members.

In this filling system, the container main bodies which have been changed by the transfer equipment to a vertical orientation are held from the outside at the rigid reinforcing component by means of the clamper of the filling equipment and thus transferred, allowing the container main bodies to be securely held. The container main bodies are sequentially moved along with a rotating table while the container main bodies are held by the clamper to allow the viscous material to be charged therein and to allow the containers to be capped with lid members by means of the charging equipment and capping equipment, thereby allowing the charging and capping operations to be carried out more efficiently and automatically.

The filling system is a filling system wherein the capping equipment furthermore comprises pressing means for pressing the drum body of the container main body filled with the viscous material to cause the surface of the viscous material to bulge.

In this filling system, the drum body of the container main body is pressed by the pressing means to cause the surface of the viscous material to bulge, allowing the container main body to be capped with a lid member while the apparent amount of the viscous material charged therein has been increased, and also allowing the lid member to be fitted to the reinforcing component while virtually all the air in the container main body has been evacuated.

More specifically, the high viscosity of the viscous material charged into the container main body results in a surface in the form of a peak with the center swelling up. Thus, when the drum body of the container main body is pressed to cause the surface of the viscous material in this state to bulge, the surface of the viscous material bulges while generally retaining a peaked shape during charging. In other words, the drum body is pressed to increase the apparent amount of the viscous material charged into the container main body.

When a lid member is fitted to the reinforcing component of the container main body while the surface of the viscous material is thus bulging outward, the lid member first fits closely to the apex of the surface of the viscous material, the tight fit between the surface of the viscous material and the lid member spreads outward as the apex of the surface of the viscous material is then flattened out, and the lid member is then fitted to the reinforcing component as the drum body of the container main body returns to its original shape, resulting in the elimination of any gap between the surface of the viscous material and the lid member, so that virtually all the air in the container main body is evacuated, and the reinforcing component is capped in an air-tight manner.

The filling system is a filling system 16, wherein the drum body is pressed by the pressing means in the capping equipment to cause the surface of the viscous material to temporarily bulge, the pressure on the drum body is then released, and the lid member is fitted to cap the reinforcing component of the container main body as the drum body returns to its original shape. With this type of structure, the drum body of the container main body is allowed to naturally return to its original shape in conjunction with the action of the lid member being fitted to the reinforcing component, and the viscous material is sealed inside the container main body with no air remaining.

The filling system is a filling system wherein the charging equipment further comprises a viscous material feed tube having a length insertable to at least the interior of the container main body, and lifting means for lifting the viscous material feed tube relative to the container main body, wherein the viscous material feed tube is inserted by the lifting means into the interior of the container main body, and the viscous material is charged into the container main body as the viscous material feed tube is pulled out of the container main body. In this case, the charging of the viscous material into the container main bodies is synchronized so as to more effectively prevent air from being mixed into the viscous material or air from being left between the container main body and the viscous material.

The method for filling flexible containers with a viscous material comprises the steps of: charging a viscous material into a container main body, the container main body comprising at least a drum body consisting of a flexible film and an open end consisting of a rigid reinforcing component, the container main body also being held vertically, with the opening on top; then pressing the drum body of the container main body to cause the surface of the viscous material to bulge; and then fitting the lid member to the opening of the reinforcing component of the container main body, and fixing the lid member in an air-tight manner to the reinforcing component.

In this filling method, the viscous material charged into the container main body results in a surface in the form of a peak with the center swelling up when the viscous material has been charged into the container main body. When the drum body of the container main body is pressed to cause the surface of the viscous material to bulge, the surface of the viscous material bulges while generally retaining a peaked shape during charging. In other words, the drum body is pressed to increase the apparent amount of the viscous material charged into the container main body.

Thus, when the lid member is fitted to the reinforcing component of the container main body while the surface of the viscous material is thus bulging, the lid member first fits closely to the apex of the surface of the viscous material, the tight fit between the surface of the viscous material and the lid member spreads outward as the apex of the surface of the viscous material is then flattened out, and the lid member is then fitted to the reinforcing component as the drum body of the container main body returns to its original shape, resulting in the elimination of any gap between the surface of the viscous material and the lid member, so that virtually all the air in the container main body is evacuated, and the reinforcing component is capped in an air-tight manner.

The filling method is a filling method wherein the drum body of the container main body is temporarily pressed and then released, and the lid member is fitted to the opening of the reinforcing component of the container main body as the drum body returns to its original shape after being released. With this structure, the drum body of the container main body is allowed to naturally return to its original shape in conjunction with the action of the lid member being fitted to the reinforcing component, and the lid member is fitted to the opening of the reinforcing component without any air being left over, and is secured in an air-tight manner to the container main body.

The filling method is a filling method wherein, to charge the viscous material into the container main body, a viscous material feed tube is first inserted into the interior of the container main body, and the viscous material is discharged from the viscous material feed tube to charge the viscous material into the container main body as the viscous material feed tube is moved in a direction away from the container main body. In this case, the charging of the viscous material into the container main bodies is synchronized so as to more effectively prevent air from being mixed into the viscous material or air from being left between the container main body and the viscous material.

The filling method is a filling method wherein the lid member is fitted to the opening of the reinforcing component of the container main body, and the lid member and reinforcing component are fixed in an air-tight manner by means of at least one of fusion (melting), a sealing agent, a gasket, or sealing tape. This structure allows an air-tight seal to be created between the lid member and the reinforcing component, and prevents external air from penetrating into the slight gap between the two so as to prevent hardening, curing and deterioration in the quality of the viscous material. For example, when the container is filled with a sealant consisting of a moisture-curing composition as the viscous material, the above structure can ensure that no moist air penetrates into the interior of the container main body, thereby preventing the viscous material from being hardened or cured by moist air. Specifically, the lid member can be secured in an air-tight manner to the reinforcing component by securing the lid member to the reinforcing component and then fusing (melting) the lid member and reinforcing component together, either directly or using a separate member, by means of heat sealing, ultrasonic sealing, high frequency induction sealing or the like, or by inserting a sealing agent or gasket in the fitting components between the lid member and reinforcing component, or by fitting and securing the lid member to the reinforcing component and then applying sealing tape between the container main body and lid member, or by combining such methods.

The viscous material filling equipment comprises: support means whereby a container main body with at least a drum body consisting of a flexible film and an open end consisting of a rigid reinforcing component is vertically held at the reinforcing component, with the opening on top; charging means for charging the viscous material into a vertically held container main body; pressing means for pressing the drum body of a container main body filled with a viscous material to cause the surface of the viscous material to bulge; lid member supply means for supplying a lid member over the container main body in which the surface of the viscous material is bulging; and capping means for fitting the lid member to the opening of the reinforcing component of the container main body and fixing the lid member in an air-tight manner to the reinforcing component.

In this filling equipment, a rigid reinforcing component is held by means of the support means to vertically support the container main body, allowing the container main body to be held in a reliable manner. The drum body is pressed by the pressing means to cause the surface of the viscous material to bulge, and the lid member can be fitted to the opening of the reinforcing component of the container main body in that state, thereby effectively preventing air from being left over in the container main body, and also allowing the lid member to be secured in an air-tight manner to the reinforcing component of the container main body to seal the viscous material inside the container main body while preventing the viscous material from leaking out of the container main body.

The viscous material filling equipment is filling equipment wherein the drum body is temporarily pressed by the pressing means and then released, and the container main body is capped with the lid member by the capping means as the drum body returns to its original shape. With this type of structure, the drum body of the container main body is allowed to naturally return to its original shape in conjunction with the action of the lid member being fitted to the opening of the reinforcing component, and the lid member is secured in an air-tight manner to the reinforcing component of the container main body without leaving any air, so as to seal the viscous material inside the container main body.

The viscous material filling equipment is filling equipment wherein the charging means further comprises a viscous material feed tube having a length insertable into at least the interior of the container main body, and lifting means for lifting the viscous material feed tube relative to the container main body, wherein the viscous material feed tube is inserted by the lifting means into the interior of the container main body, and the viscous material is charged into the container main body as the viscous material feed tube is pulled out of the container main body. In this case, air is effectively prevented from being mixed into the viscous material or air is effectively prevented from being left over between the container main body and the viscous material when the viscous material is charged into the container main body.

The container filled with a viscous material comprises: a container main body with at least the drum component consisting of a flexible film, and the open end consisting of a rigid reinforcing component; a lid member fixed in an air-tight manner to the reinforcing component of the container main body; and a viscous material charged into the container main body; wherein the drum body of the container main body is pressed to cause the surface of the viscous material to bulge after the viscous material has been charged into the container main body, the lid member is then fitted to the opening of the reinforcing component of the container main body, and the lid member is fixed in an air-tight manner to the reinforcement component as the drum component returns to its original shape, allowing the viscous material to thus be charged into the container main body without any air being left over.

In this filled container, the drum body of the container main body is made of a flexible film, allowing the viscous material to be extruded or discharged from the container main body as the drum body is squeezed, and also allows the container to be squeezed into a smaller size after use, thereby reducing waste volume.

Since, furthermore, the lid member is secured to the reinforcing component which is integrated with the container main body, without any change in the positional relationship between the lid member and reinforcing component, it is possible to ensure an air-tight seal between the two. The lid member is also fitted to the opening of the reinforcing component of the container main body while the drum body of the container main body is pressed to cause the viscous material to bulge, thereby effectively preventing air from being left over in the container main body, and allowing the lid member to be secured in an air-tight manner to the reinforcing component to seal the viscous material inside the container main body while preventing the viscous material from leaking out of the container main body.

In the filled container the lid member is fixed in an air-tight manner to the reinforcement component by means of at least one of fusion (melting), a sealing agent, a gasket, or sealing tape. This structure allows an air-tight seal to be created between the lid member and reinforcing component in order to prevent external air from penetrating into the container main body, thereby effectively preventing hardening, curing and deterioration in the quality of the viscous material. Specifically, the lid member can be secured in an air-tight manner to the reinforcing component by fitting and securing the lid member to the reinforcing component and then fusing (melting) the lid member and reinforcing component together, either directly or using a separate member, by means of heat sealing, ultrasonic sealing, high frequency induction sealing or the like, or by inserting a sealing agent or gasket in the fitting component between the lid member and reinforcing component, or by fitting and securing the lid member to the reinforcing component and then applying sealing tape between the container main body and lid member, or by combining such methods.

DESCRIPTION OF THE PREFERRED EMBODIMENTS

Examples of the present invention are described below with reference to the drawings.

The structure of a container 1 filled with a viscous material is described first.

Figure 1:
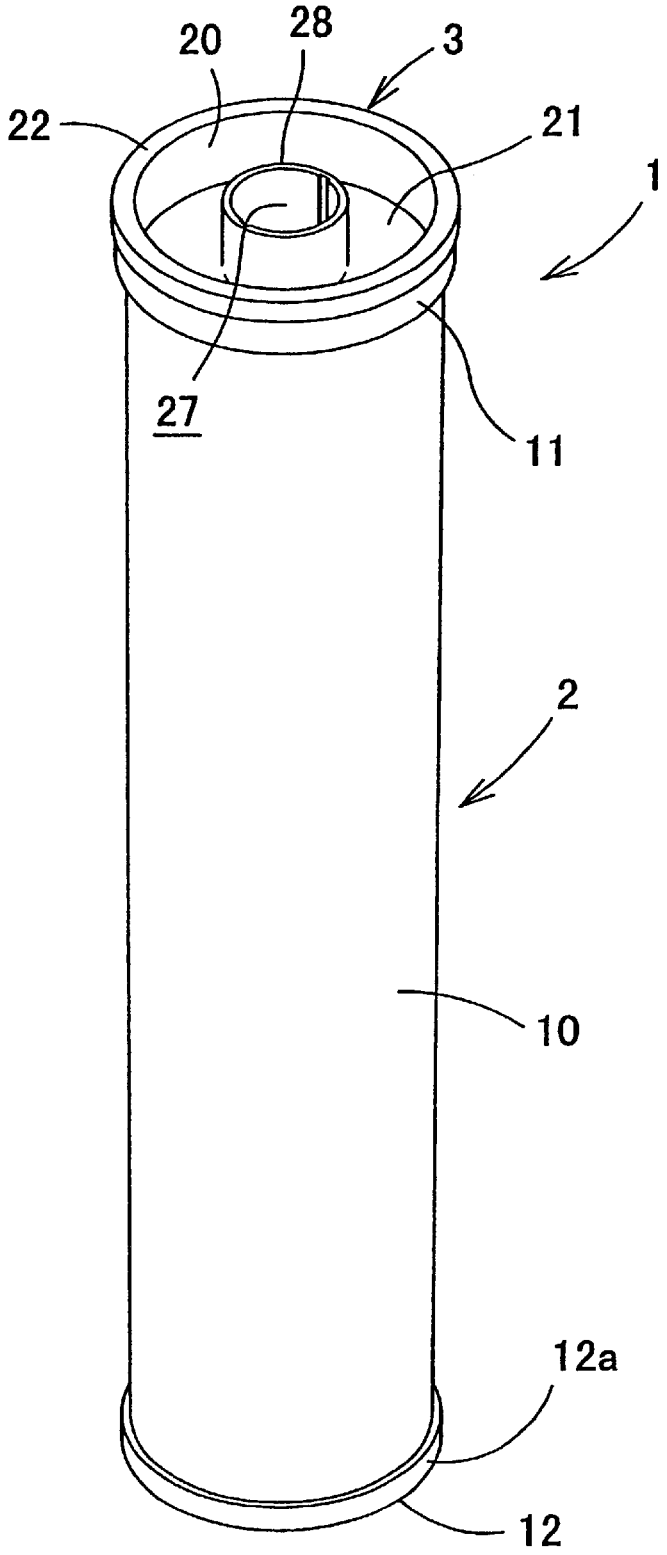
FIG. 1 is an oblique view of a container filled with a viscous maternal.
Figure 2:
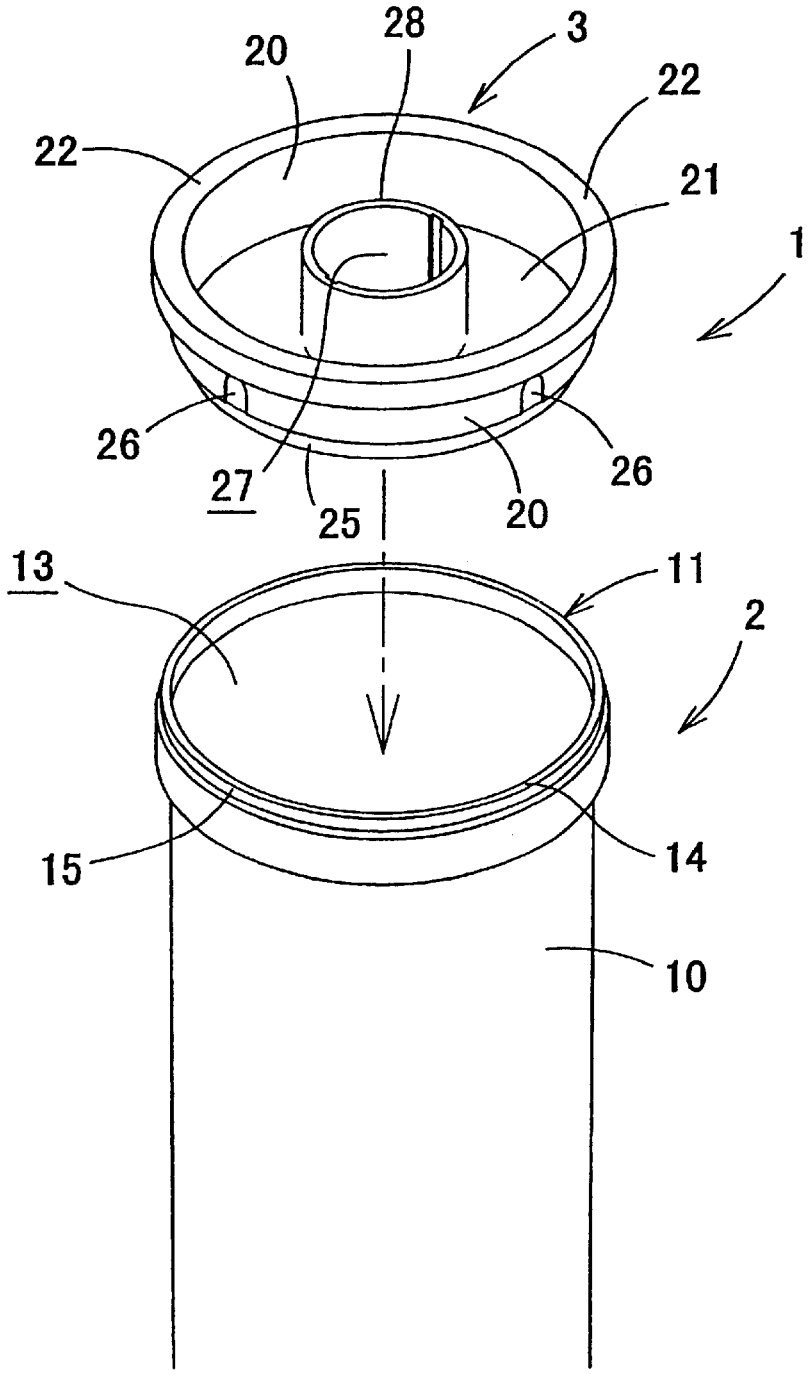
FIG. 2 is an exploded oblique view of a container filled with a viscous material.
Figure 3:
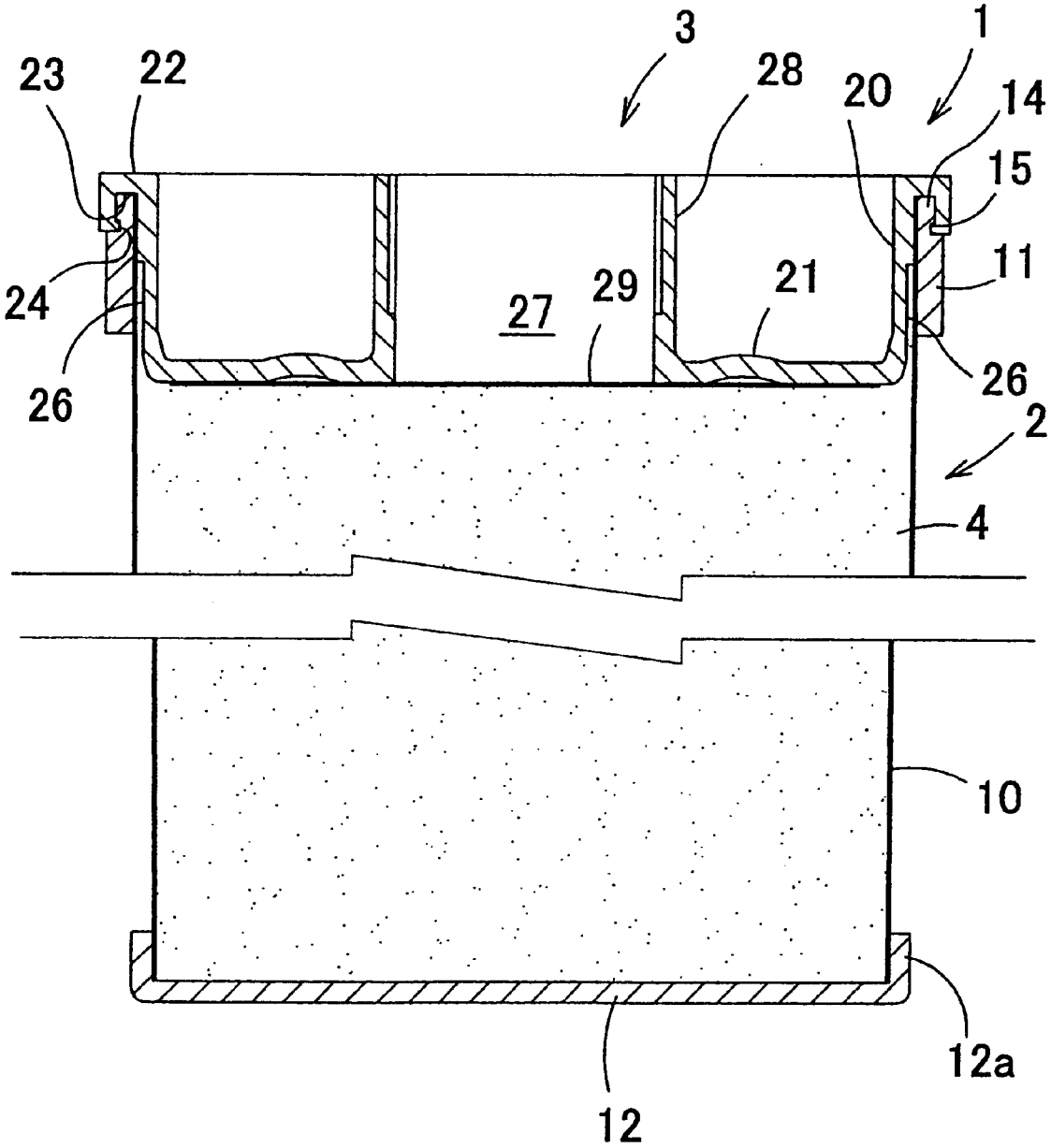
FIG. 3 is a vertical cross section of the main parts of a container filled with a viscous material.
Figure 4:
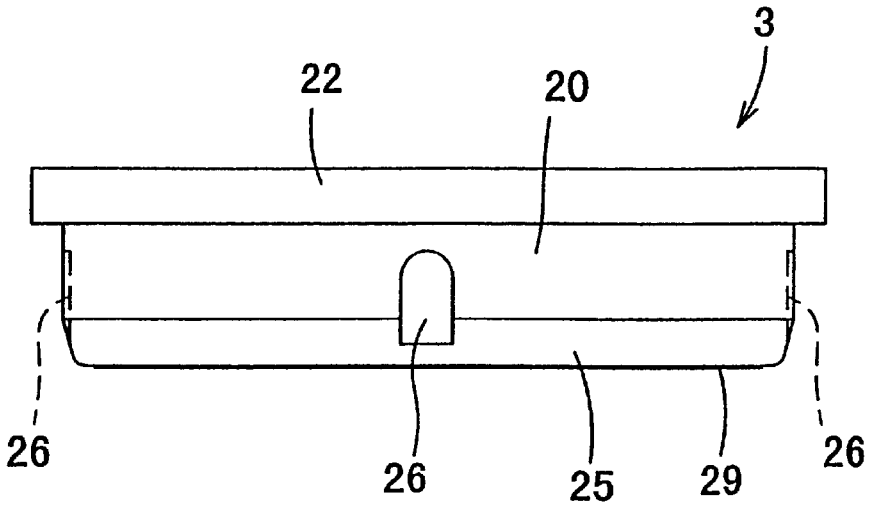
FIG. 4 is a side view of a lid member.

As illustrated in FIGS. 1 through 3, the container 1 filled with a viscous material comprises a container main body 2 in the form of a cylindrical member, a lid member 3 secured in an air-tight manner to the container main body 2, and a viscous material 4 such as construction sealant or adhesive with which the interior of the container main body 2 is filled.

As described thus, the container main body 2 is provided with a drum body 10 consisting of a film material in the form of a flexible film, the upper end of the drum body 10 is integrally provided with a reinforcing ring 11 as a rigid reinforcing component, the bottom end of the drum body 10 is integrally provided with a disc-shaped bottom plate member 12, an opening 13 is formed by means of the reinforcing ring 11 in the upper end of the container main body 2, and the bottom end of the container main body is closed off by the bottom plate member 12.

The film material forming the drum body 10 can consist of any material that is flexible enough to be squeezed into a smaller size, such as single-layered or multi-layered film materials consisting of resin film, or multi-layered film materials comprising a metal foil such as aluminum foil laminated between resin films. The present example features the use of a triple-layered structure comprising aluminum foil laminated between two resin films, this film material being rolled into a mandrel and in that state heat sealed at the overlapping edges. Polyethylene, polyester, polypropylene, nylon, and the like can be used as material for the resin film. Although the internal and external resin films can be made of the same material, since the conditions of use are different on the inside and outside, the use of resin film consisting of a material suited to such conditions of use is preferred. For example, when the container main body 2 is filled with a construction sealant as the viscous material 4, the resin film for the inside surface is preferably a film of polyethylene, polypropylene, or the like which is not degraded or the like by contact with the sealant, whereas the resin film for the outside surface is preferably a film of polyester, nylon, or the like in view of the importance of strength and gas barrier properties.

An upwardly extending ring-shaped protrusion 12*a* is formed at the outer periphery of the bottom plate member 12, the bottom end of the drum body 10 is fitted in an air-tight manner to the inner peripheral surface of the protrusion 12*a*, and the bottom end of the drum body 10 is thus closed off by the bottom plate member 12.

The upper end of the drum body 10 overlaps the inner peripheral surface of the reinforcing ring 11 up to a location slightly under the upper end of the reinforcing ring 11 and is thus fitted in an air-tight manner. An upwardly protruding fitting protrusion 14 is formed in the shape of a ring at the upper end of the reinforcing ring 11, and a fitting groove 15 is formed in the outer peripheral surface of the fitting protrusion 14.

The reinforcing ring 11 and bottom plate member 12 facing the drum body 10 may be secured by heat sealing or the like, or the drum body 10 may be mounted in an injection molder to allow the reinforcing ring 11 and bottom plate member 12 to be integrally formed relative to the drum body 10. The drum body 10 can also be integrally molded with the reinforcing ring 11 and/or bottom plate member 12 by blow molding.

As illustrated in FIGS. 1 through 4, the lid member 3 comprises the unitary formation of a sliding cylinder 20 inserted into the reinforcing ring 11, a lid main member 21 extending inward from the bottom end of the sliding cylinder 20 to close off the opening 13 of the container main body 2, and a rim 22 outwardly extending from the upper end of the sliding cylinder 20. And the lid member comprises a ring-shaped groove 23 that opens downward and fits around the fitting protrusion 14 of the reinforcing ring 11 is formed in the rim 22, and a ring-shaped protrusion 24 that protrudes into the ring-shaped groove 23 and locks into the fitting groove 15 of the reinforcing ring 11 is also formed.

The sliding cylinder 20 of the lid member 3 is inserted into the reinforcing ring 11, the fitting protrusion 14 of the reinforcing ring 11 is fitted to the ring-shaped groove 23 of the lid member 3, the protrusion 24 of the lid member 3 is locked into the fitting groove 15 of the reinforcing ring 11, and the outer periphery of the rim 22 is secured in an air-tight manner to the reinforcing ring 11. Lubricating oil or the like may be applied beforehand to the outer surface of the sliding cylinder 20 to allow the sliding cylinder 20 to be more smoothly inserted into the reinforcing ring 11.

Figure 5:
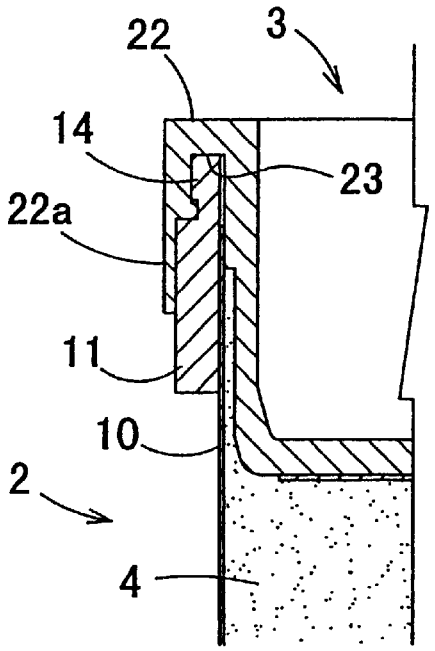
FIG. 5 is a vertical cross section of the main parts of another seal structure based on fusion.

As illustrated in FIG. 5, to improve the reliability of the air-tightness between the reinforcing ring 11 and the lid member 3, a thin-walled, cylindrical fused component 22*a*extending downward along the outer periphery of the reinforcing ring 11 may be formed on the rim 22, and the fused part 22*a* may be fused to the reinforcing ring 11. A sealing agent consisting of a thermoplastic resin material may also be disposed along the fitting ends between the reinforcing ring 11 and the lid member 3, and the sealing agent may be fused to the reinforcing ring 11 and the lid member 3. Heat sealing, ultrasonic sealing, high frequency induction sealing, or the like can be suitable for use as the fusion method.

Figure 6:
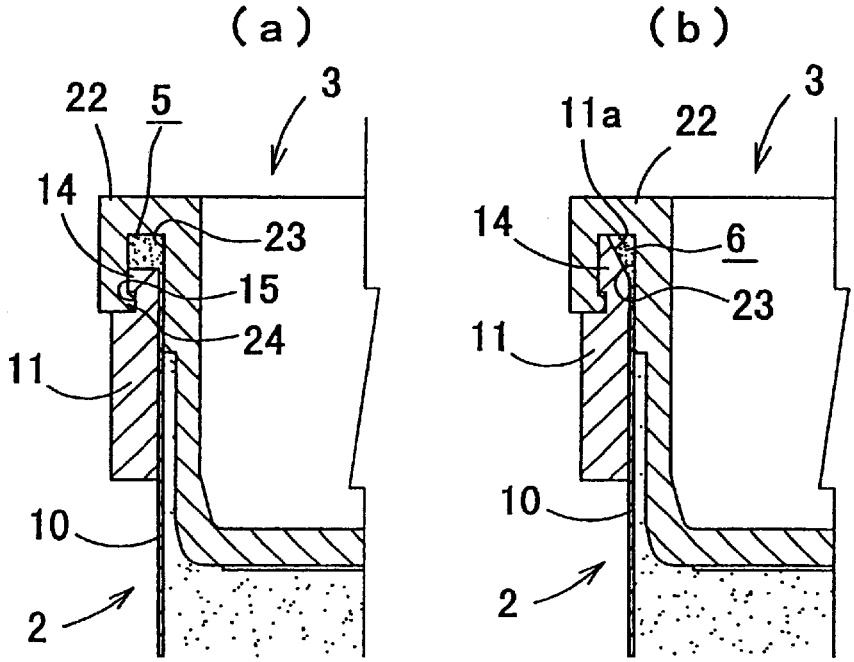
FIGS. 6(*a*) and (*b*) are vertical cross sections of the main parts of another seal structure featuring the use of a sealing agent.

As an alternative to fusion, a sealing agent such as an adhesive or self-adhesive may be used to secure the reinforcing ring 11 and the lid member 3 in an air-tight manner to the inside of the ring-shaped groove 23 of the lid member 3 and/or the fitting protrusion 14 of the reinforcing ring 11, and in cases where the viscous material 4 is an adhesive, self-adhesive, or the like, the viscous material 4 can be charged in such a way as to fill in the space between the fitting protrusion 14 of the reinforcing ring 11 and the ring-shaped groove 23 of the lid member 3. As shown in FIG. 6(*a*), when the space between the reinforcing ring 11 and the lid member 3 is sealed by a sealing agent such as an adhesive, self-adhesive, or the viscous material 4, it is desirable to form a ring-shaped space 5 between the upper end of the reinforcing ring 11 and the interior end of the ring-shaped groove 23, and to then fill the ring-shaped space 5 with a sealing agent while the protrusion 24 of the lid member 3 is locked into the fitting groove 15 of the reinforcing ring 11 because the sealing agent can be prevented from leaking out through the gap between the reinforcing ring 11 and the lid member 3 while ensuring adequate sealing performance. In addition, as illustrated in FIG. 6(*b*), it is also possible to form a ring-shaped tapering component 11*a* in the upper end of the reinforcing ring 11 and to form a ring-shaped space 6 in the ring-shaped groove 23, which in this case is desirable because the lid member 3 is easier to position relative to the reinforcing ring 11. Polyurethane, silicone, modified silicone, modified polysulfide, acrylic, butyl rubber, SBR, fluorine, acrylic silicone, and the like are suitable for use as sealing agents. A gasket such as a sealing ring or packing may also be mounted in the fitting component between the reinforcing ring 11 and the lid member 3 to improve the seal. Although a rubber gasket may be used for the gasket, a forming in place gasket may also be used. In this case, a thermoplastic hot melt composition can be applied in a heated molten state as the forming in place gasket in the ring-shaped groove 23, the lid member 3 can be fitted to the reinforcing ring 11, and the thermoplastic hot melt composition can be cooled and solidified or foamed to provide a seal.

Figure 7:
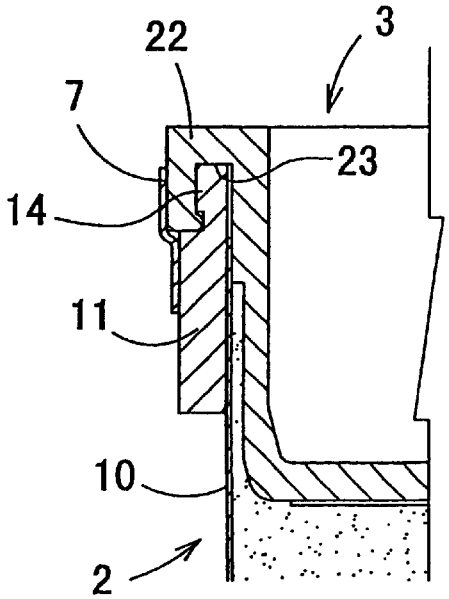
FIG. 7 is a vertical cross section of the main parts of another seal structure featuring the use of sealing tape.

In addition, as illustrated in FIG. 7, sealing tape 7 may be applied between the lid member 3 and the reinforcing ring 11 to create an air-tight seal in the fitting component between the two parts. A heat seal.or sealing agent or sealing tape 7 may also be combined to create an air-tight seal in the fitting component between the lid member 3 and the reinforcing ring 11.

A tapered component 25 with a diameter that decreases in the downward direction is formed on the bottom outer peripheral surface of the sliding cylinder 20 of the lid member 3. Formed at intervals in the peripheral direction midway in the sliding cylinder 20 are gas venting grooves 26, the bottom ends of which open inside the container main body 2, and the upper ends of which extend to the vicinity of the rim 22.

As illustrated in FIG. 3, a discharge hole 27 is formed in the center of the lid main member 21, and a downwardly extending cylinder 28 is integrally formed with the discharge hole 27. Virgin film 29 closing off the discharge hole 27 is attached to the bottom face of the lid main member 21, the virgin film 29 is cut at the time of use to allow a nozzle not shown in the figure to be attached to the cylinder 28, and the viscous material is discharged through the nozzle.

The system 30 for filling container main bodies 2 with viscous material 4 is described below.

Figure 8:
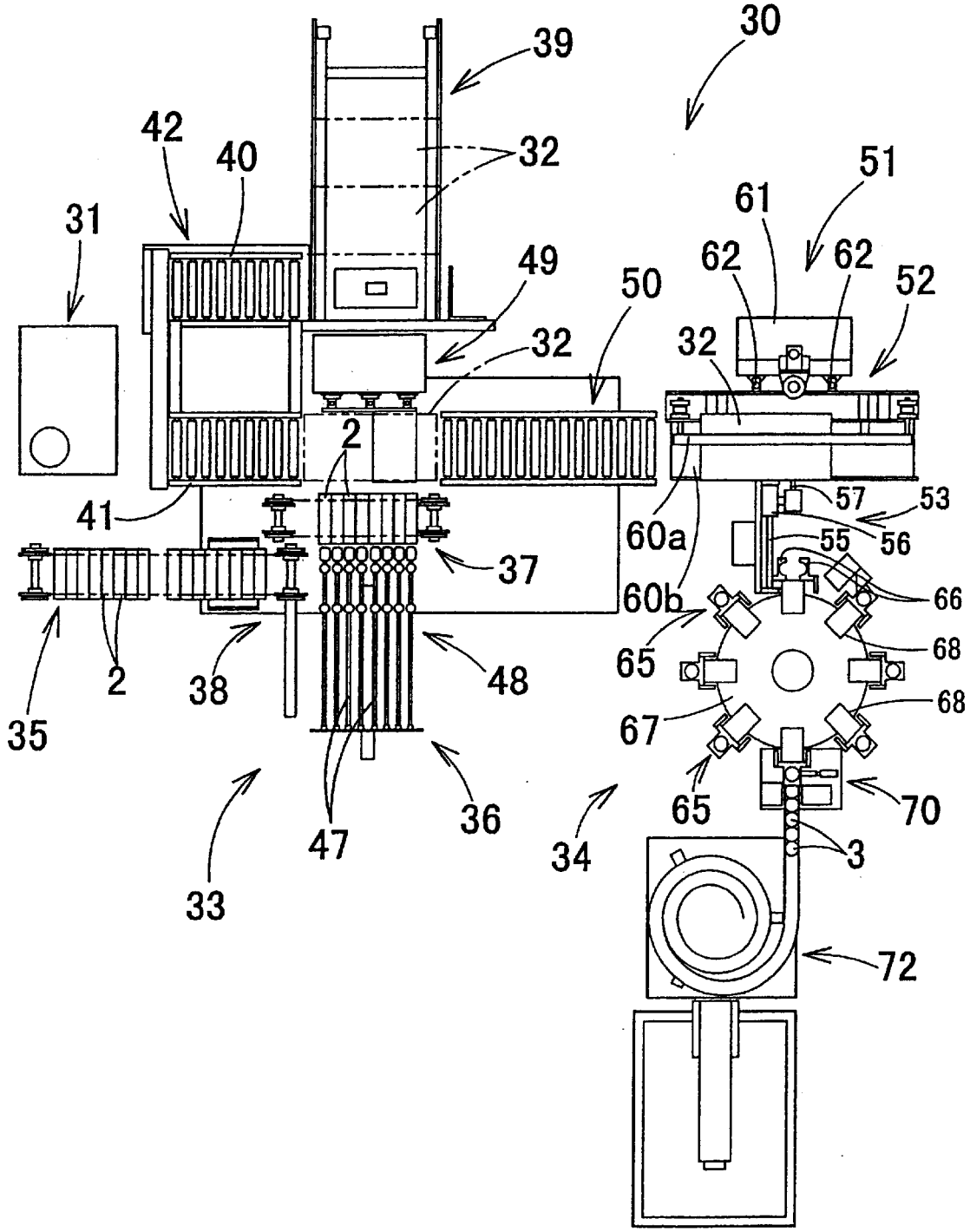
FIG. 8 is a plan of the viscous material filling system.

As illustrated in FIG. 8, the filling system 30 comprises a conveying system 33 whereby container main bodies 2 produced by container producing equipment 31 are conveyed using a carrying box 32, and filling equipment 34 for filling the conveyed container main bodies 2 with a viscous material 4.

As described thus, the front end of the container producing equipment 31 in the conveying system 33 is provided with a first chain conveyor 35 extending to the right. A plurality of units (4 units in the present example) of container main bodies 2 produced by the container producing equipment 31 are moved reciprocally in the longitudinal direction, with the open ends 13 facing forward, by means of moving equipment not shown in the figure, on the first chain conveyor 35. The right side of the first chain conveyor 35 is provided with packing equipment 36 for packing the container main bodies 2 into the carrying box 32, and a second chain conveyor 37 extending into the packing equipment 36 is provided under the down stream end of the first chain conveyor 35. The container main bodies 2 conveyed to the downstream end of the first chain conveyor 35 are ejected backward by means of ejection equipment 38 and sequentially moved on to the second chain conveyor 37.

A stocker 39 for stocking the carrying box 32 is provided behind the packing equipment 36, and the carrying boxes 32 are supplied behind the second chain conveyor 37 by means of conveying equipment 42 consisting of roller conveyors 40, 41, etc.

Figure 9:
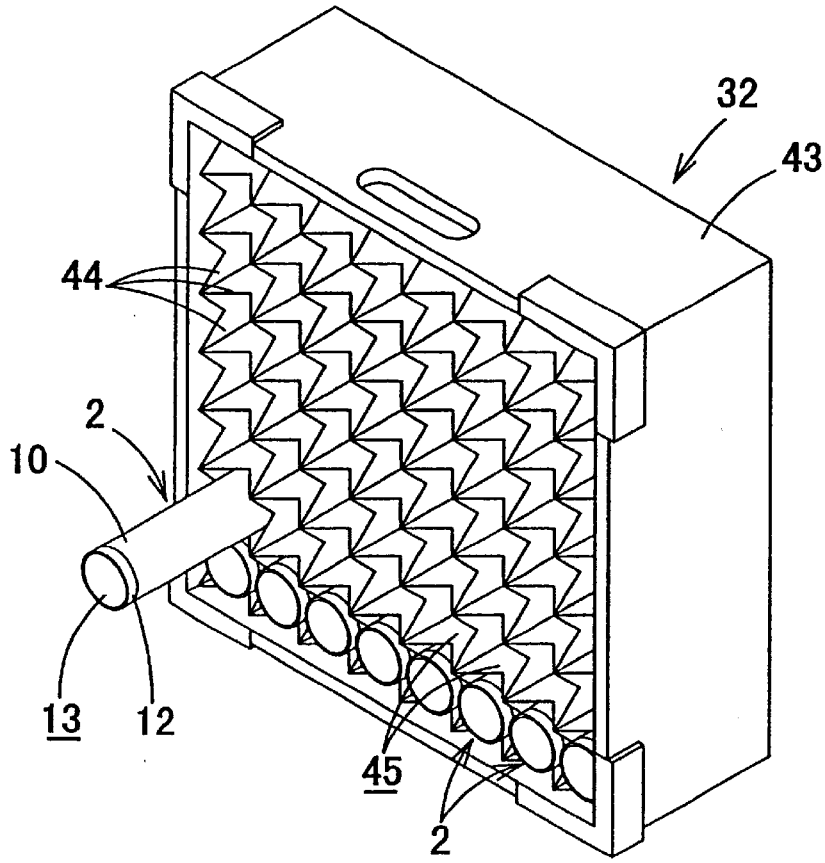
FIG. 9 is an oblique view of a carrying box.
Figure 10:
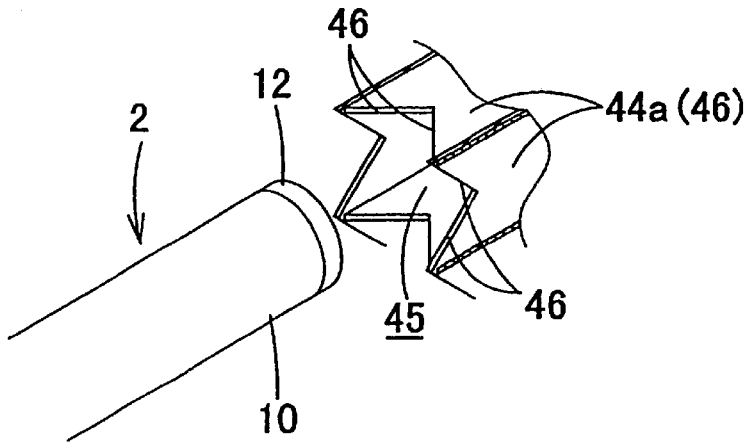
FIG. 10 is an oblique view of the main parts of a carrying box.
Figure 11:
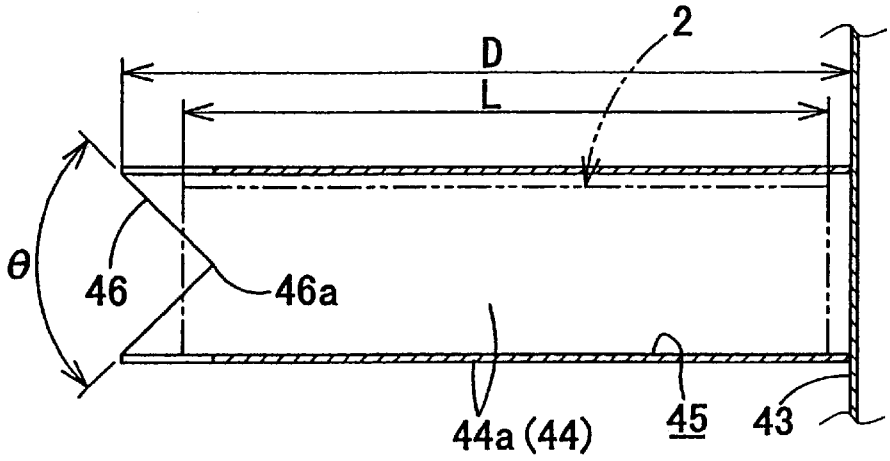
FIG. 11 is a vertical cross section of a carrying box.

As illustrated in FIGS. 9 through 11, the carrying box 32 comprises a box main body 43 and dividing plates 44 arranged in the form of a lattice inside the box main body 44. The interior of the box main body 43 is divided by the dividing plates 44 into a plurality of open-ended, longitudinally extending housing components 45. The housing components 45 accommodate the container main bodies 2 in the form of cylindrical members in such a way that they can be placed therein and taken out, with a plurality of longitudinal and lateral columns and rows (8 columns and 8 rows in the figures) formed therein. V-shaped notches with the notch width narrowing in the depthwise direction are formed in the region including the approximate center in at least the widthwise direction of the open ends of the four dividing plates forming the housing components 45.

Figure 12:
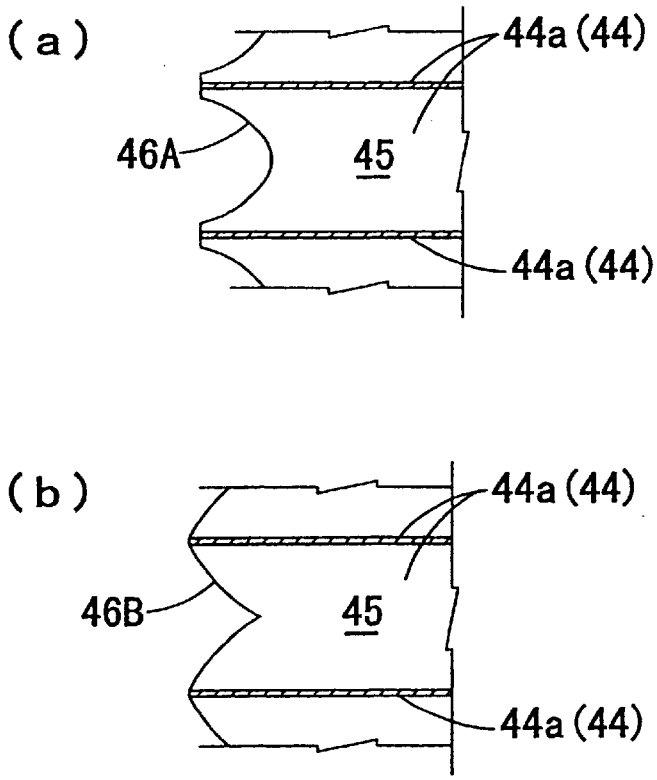
FIG. 12 is a vertical cross section of the main parts of a carrying box having another structure.

When the angle θ of the apex 46*a* of the notch 46 is too little, the notch will be so deep that the strength of the dividing plates 44 will be compromised, whereas too great an angle does not allow the inserted end of the container main bodies 2 to be smoothly guided therein, so the angle must be properly set in light of these considerations. A notch 46 constructed with the notch width narrowing in the depthwise direction allows a variety of shapes to be used, such as a notch 46A that is parabolically notched as shown in FIG. 12(*a*) or a notch 46B with an inwardly swelling midsection as shown in FIG. 12(*b*).

The depth D of the housing component 45 is shallower than the length of the container main body 2. When the drum body of the container main body 2 is a flexible film, however, the depth is preferably longer than the length of the container main body 2 because of potential damage to that part during transport.

Figure 13:
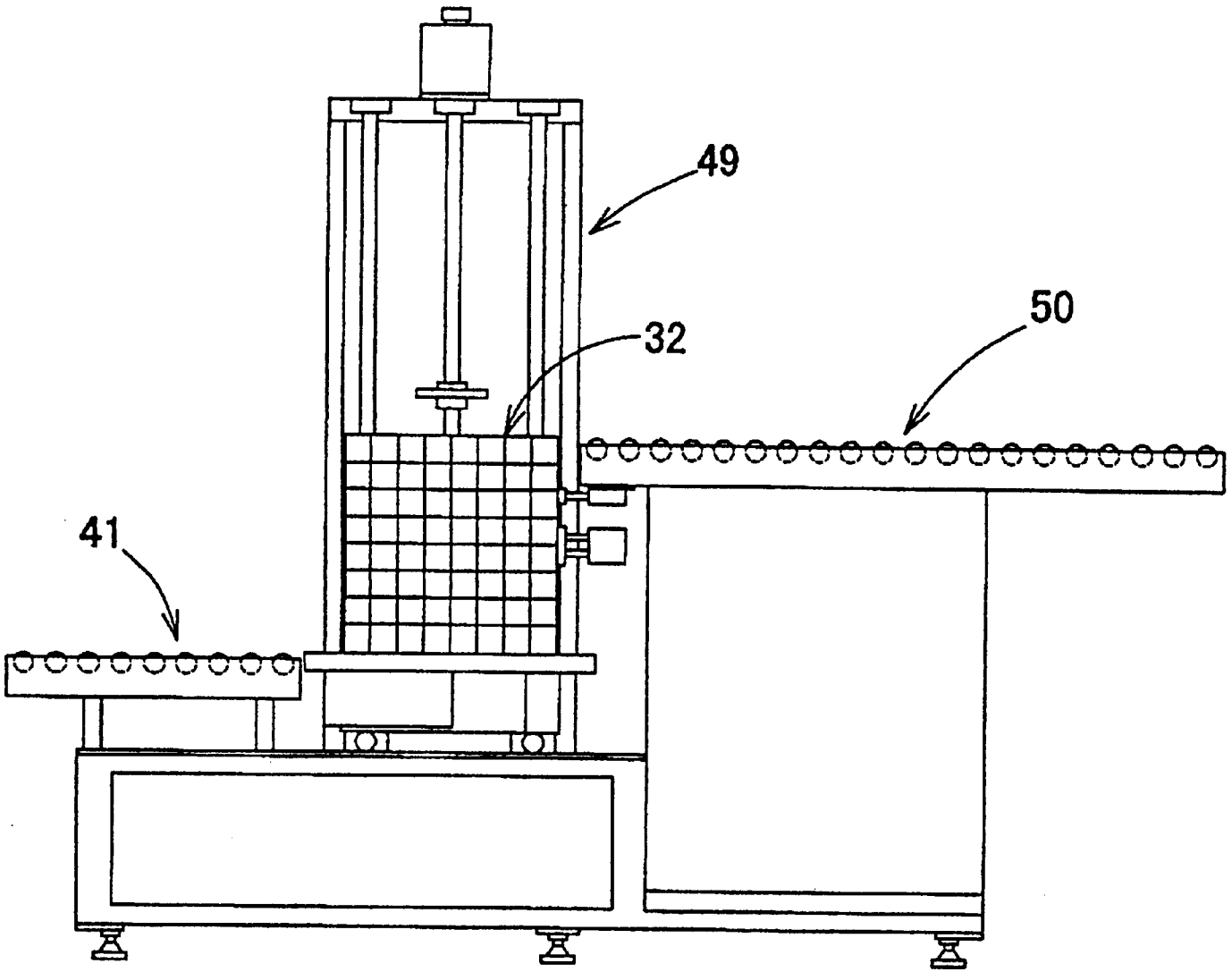
FIG. 13 is an elevation of the main parts of a conveying system.

As described thus, the packing equipment 36 is such that, as illustrated in FIGS. 8 and 13, an ejector means 48 whereby 8 container main bodies 2 positioned on the second conveyor 37 are simultaneously ejected backward by means of 8 ejection rods 47 is provided in front of the second chain conveyor 37, a lifting means 49 for lifting the carrying box 32 is provided behind the second chain conveyor 37, and the container main bodies 2 are sequentially packed 8 at a time from the housing components 45 at the top end of the carrying box 32 by means of the ejector means 48 and lifting means 49. Container main bodies 2 thus packed in all the housing components 45 are conveyed by the roller conveyor 50 to the filling equipment 34. The number of ejection rods 47 has been set to 8 according to the number of housing components 45 in the lattice of the carrying box 32, but the number may also be more than 8. The 8 ejection rods 47 are preferably used to eject container main bodies simultaneously because the packing equipment 36 can thus be given a simpler structure, but the containers may also be ejected at varying times.

Because a carrying box 32 with notches 46 is used in the packing equipment 36, when the container main bodies 2 are ejected backward by the ejector means 48 and thus packed into the housing components 45 of the carrying box 32, the container main bodies come into contact with the notches 46, despite slight displacement in the position of the rear end of the container main bodies 2, and are thus guided toward the center of the housing components 45 and smoothly accommodated in the housing components 45, so that even container main bodies 2 having drum bodies 10 made of flexible films can be smoothly accommodated in the housing components 45.

As illustrated in FIG. 8, transfer equipment 51 that takes out the container main bodies 2 one at a time from the carrying box 32 and transfers them while vertically oriented to the filling equipment 34 is provided at the downstream end of the roller conveyor 50.

The transfer equipment 51 comprises a position changing means 52 disposed to the right of the roller conveyor 50, and a transfer means 53 disposed between the filling equipment 34 and the position changing means 52.

The transfer means 53 is described with reference to FIGS. 8, 14, and 15. A support rod 54 is provided behind the filling equipment 34, and the support rod 54 is provided with a guide rod 55 extending in the reciprocal direction. The guide rod 55 is provided with a movable base 56 that is moved to and fro by means of a drive means not shown in the figure. The movable base 56 is provided with an arm member 57 that can be rotated by drive means not shown in the figure to the horizontal position illustrated in FIG. 14 and the vertical position illustrated in FIG. 15. The distal end of the arm member 57 is provided with an expanding head 58 that can open out wider than the inside diameter of the container main bodies 2 to hold the container main bodies 2 from the inside. The expanding head 58 is a balloon type that is expanded and contracted by air pressure. The expanding head 58 is designed so as to be movable in the longitudinal direction to the arm member 57 by means of expanding and contracting means not shown in the figure.

The position changing means 52 sequentially moves the carrying box 32 vertically and laterally so that the prescribed housing components 45 of the carrying box 32 face the expanding head 58 which is held in horizontal orientation. While the carrying box 32 is held between a laterally extending set of upper and lower belts 60*a* and 60*b*, the upper and lower belts 60*a* and 60*b* are synchronized by an electric motor and rotated in the reverse direction, allowing the carrying box 32 to be moved laterally. While the carrying box 32 is held between the belts 60*a* and 60*b*, it can be moved vertically by the electric motor along the guide rail 62 vertically extending before the foundation base 61.

Figure 14:
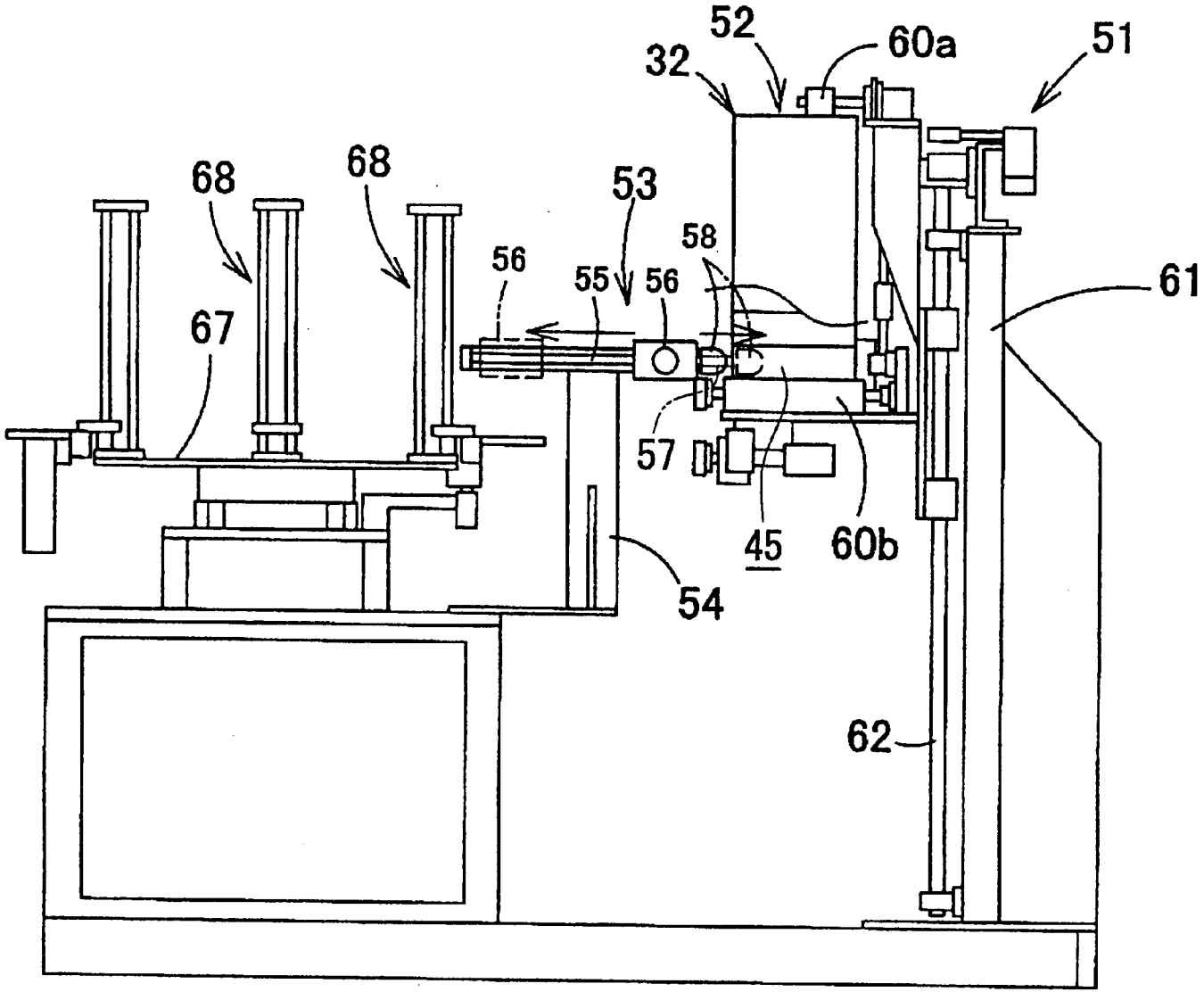
FIG. 14 is a side view of transfer equipment.
Figure 15:
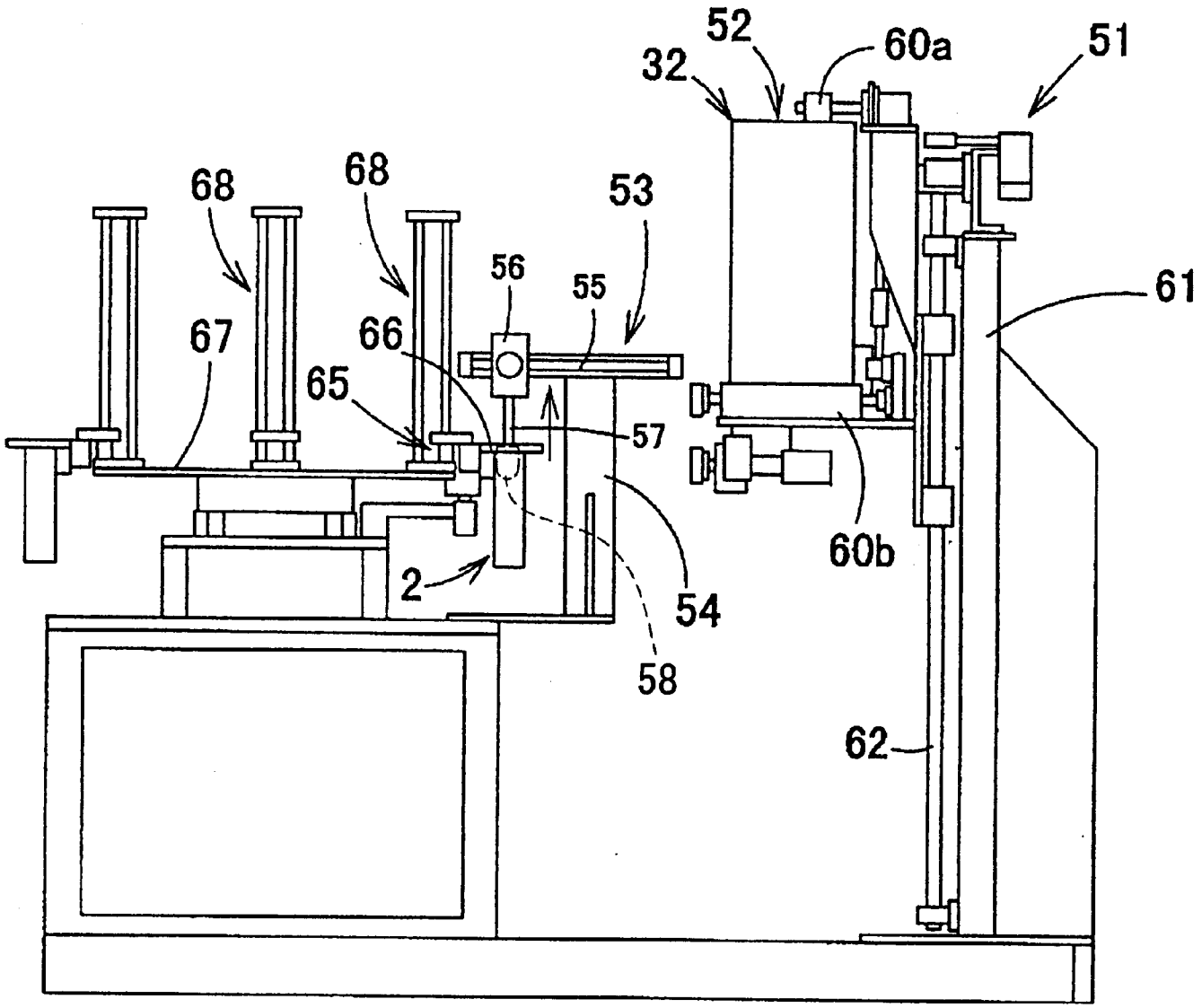
FIG. 15 illustrates the operation of the transfer equipment.
Figure 16:
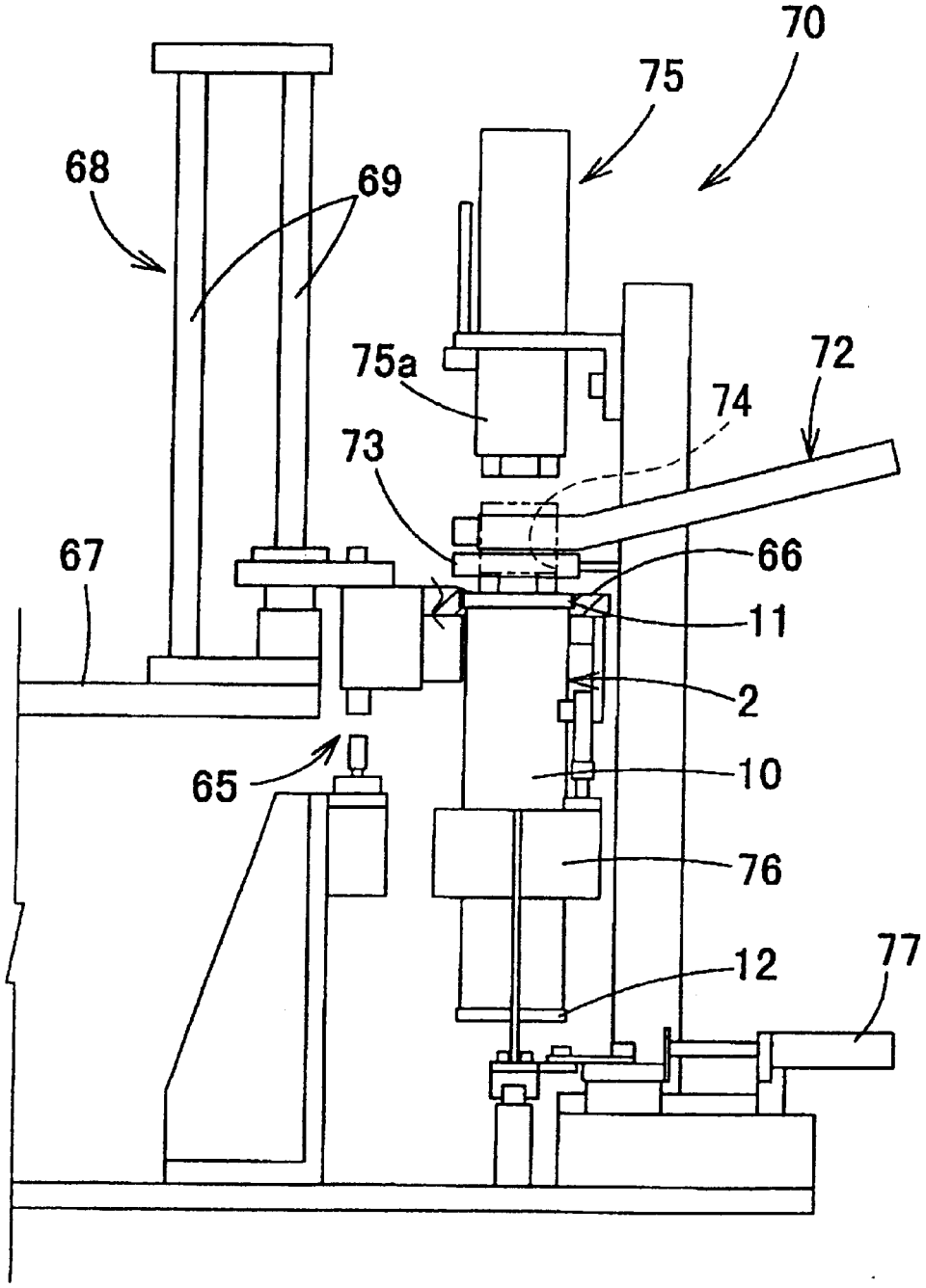
FIG. 16 is a side view of a filling means.
Figure 17:
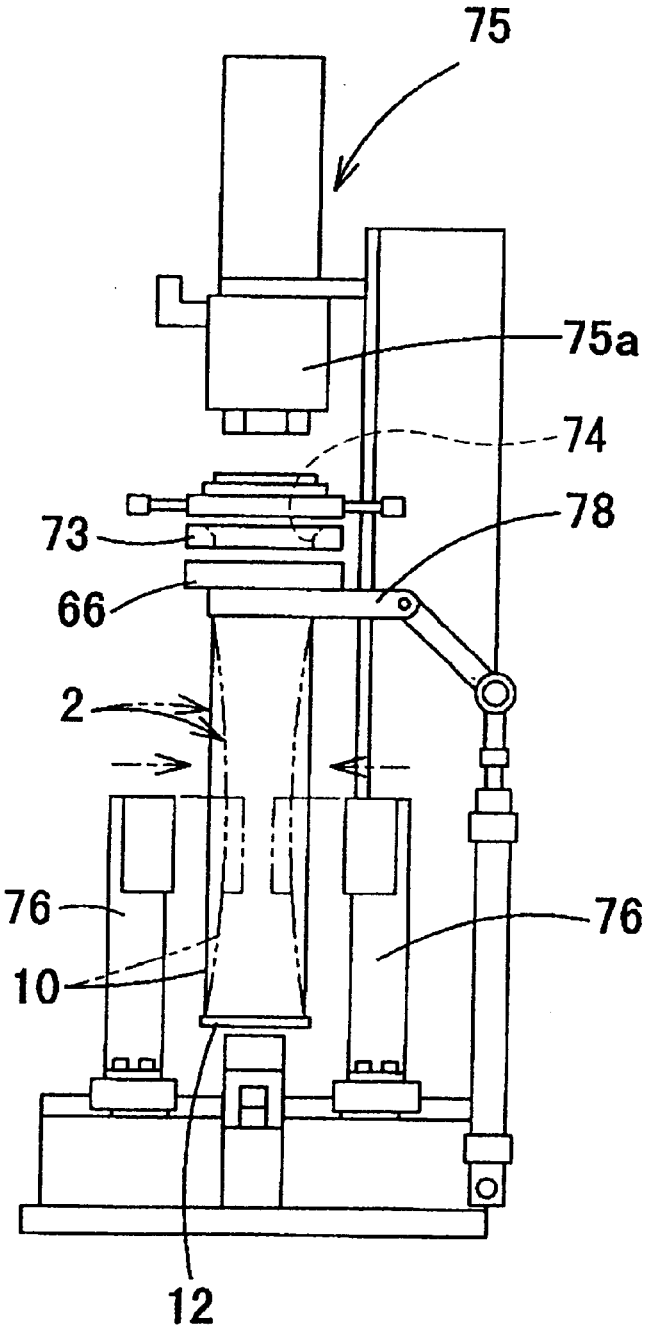
FIG. 17 is an elevation of a filling means.

As illustrated in FIG. 14, the arm member 57 is held horizontally in the transfer equipment 51, the arm member 57 is retracted along with the movable base 56 while the prescribed housing components 45 of the carrying box 32 face toward the expanding head 58 by means of the position changing means 52, the expanding head 58 is inserted into the reinforcing ring 11 of the container main body 2 by means of the expanding and contracting means, the expanding head 58 is then expanded to hold the container main body 2, the arm member 57 is moved forward along with the-movable base 56 in this state, and the container main bodies 2 are thus taken out of the housing components 45 of the carrying box 32. Then, as shown in FIG. 15, the container main body 2 is rotated into vertical orientation along with the arm member 57, the outer periphery of the reinforcing ring 11 is held by the holding clamps 66 of the clamper 65 of the filling equipment 34 to transfer the container main body 2 to the filling equipment 34, the expanding head 58 is then contracted, in this contracted state the expanding head 58 is moved upward by the expanding and contracting means, the expanding head 58 is detached from the reinforcing ring 11, and the next container main body 2 is then transferred by the same means as above.

In this example, the conveyor system 33 conveyed the container main bodies while accommodating them horizontally using a carrying box 32, but the conveying system can also convey the container main bodies 2 while accommodating them vertically.

The filling equipment 34 is described below. As shown in FIGS. 8 and 15 through 17, a rotating table 67 is provided. 8 support means 68 for vertically supporting the container main bodies 2 transferred from the transfer equipment 51 are provided at fixed intervals In the peripheral direction, at 45° in the peripheral direction in the figure. The support means 68 comprises a clamper 65 having a pair of holding clamps 66 for holding the reinforcing ring 11 of the container main body 2, and a guide rod 69 for moveably guiding the clamper 65 up and down. More than 8 support means 68 may be provided.

Charging equipment not shown in the figure for charging the viscous material 4 into the container main body 2 is provided to the right of the rotating table 67. Capping equipment 70 for capping the lid member 3 onto the container main body 2 filled with the viscous material 4 is provided in front of the rotating table 67 . Fusion equipment not shown in th e figure for fusing the lid member 3 to the reinforcing ring 11 is provided to the left of the rotating table 67. The rotating table 67 is moved at a pitch of 45° increments to charge the viscous material 4 into the container main bodies 2, the container is capped with the lid member 3, and the lid member 3 is fused to the reinforcing ring 11. The containers 1 filled with the viscous material 4 are conveyed to the left of the rotating table 67.

Figure 18:
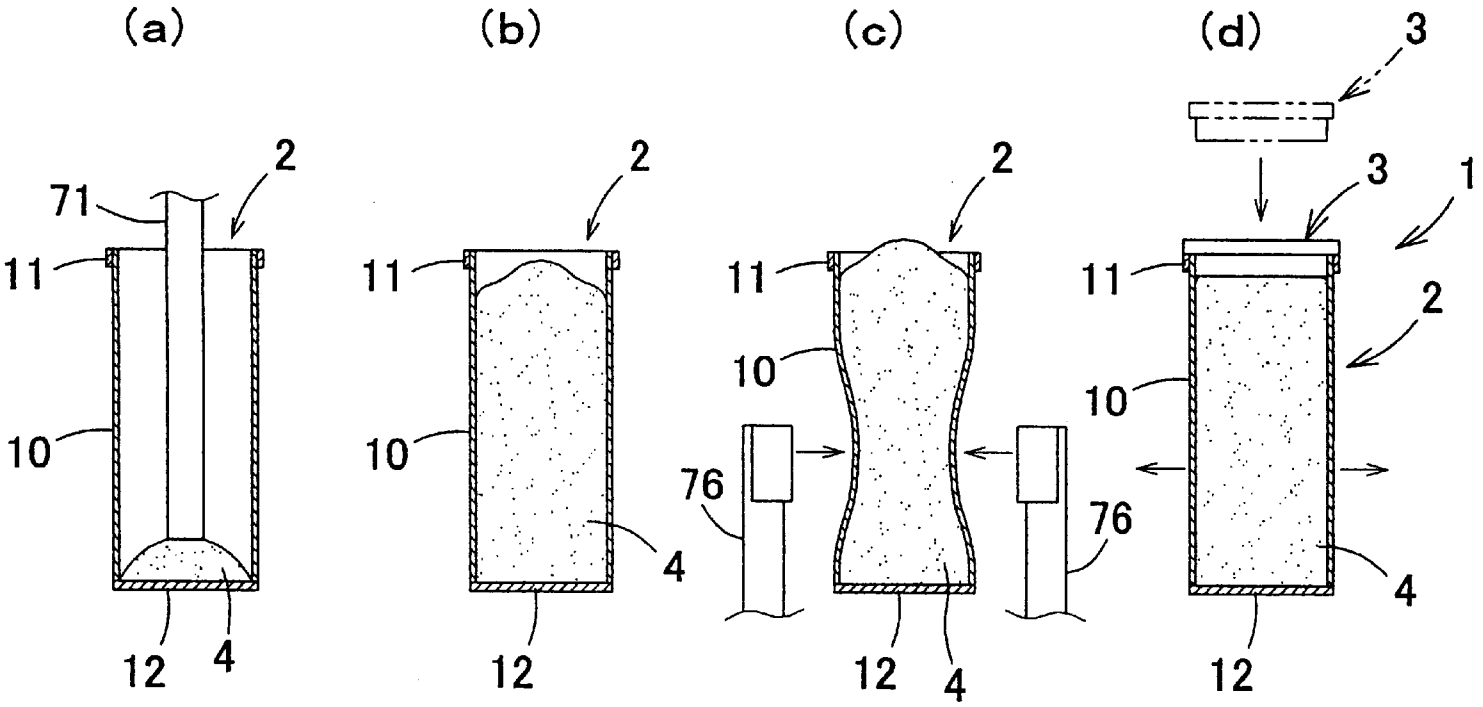
FIG. 18 is an illustration of the method for filling a container main body with a viscous material.

Although the charging equipment is not shown in the figure, it comprises a viscous material feed tube 71 (see FIG. 18(*a*)) disposed above the container main bodies 2 moved by the rotating table 67, and a lifting means for lifting the container main bodies along the guiding rod 69 together with the clamper 65. The container main bodies 2 are lifted by the lifting means, and the container main bodies 2 are lowered as the viscous material 4 is discharged from the viscous material feed tube 71 while the viscous material feed tube is inserted into the interior of the container main bodies 2, thus allowing the viscous material 4 to be charged into the container main bodies 2 without any air bubbles being mixed therein. When the lifting means is designed to allow the viscous material feed tube 71 to be lifted relative to the container main bodies 2, the container main bodies 2 may be secured, and the viscous material feed tube 71 may be lifted, allowing both the viscous material feed tube 71 and container main bodies 2 to be lifted.

Figure 19:
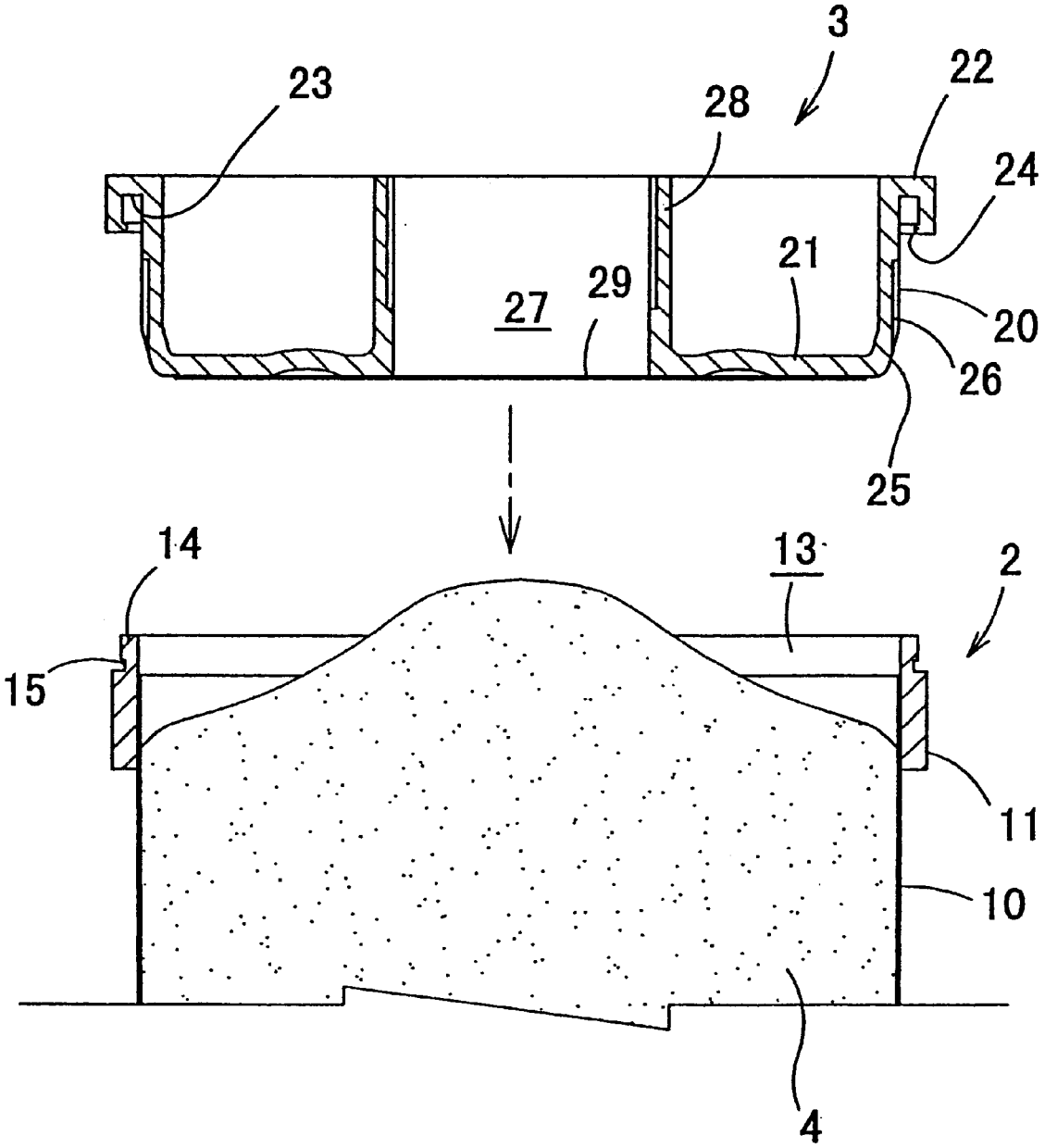
FIG. 19 is an illustration of the state just before the container main body begins to be capped with a lid member.

The capping equipment 70 is described below. A holding component 73 for individually holding lid members 3 sequentially supplied from a lid member supplying means 72 is provided above the clamper 65. A discharge hole 74 (see FIG. 19) of somewhat smaller diameter than the lid member 3 is formed in the holding component 73. The upper inner surface of the discharge hole 74 is tapered, narrowing in diameter in the downward direction.

A capping means 75 for capping the reinforcing ring 11 of the container main body 2 under the discharge hole 74 with the lid member 3 held by the holding component 73 is provided above the holding component 73. The lid member 3 is supplied by the lid member supply means 72 and is capped onto the reinforcing ring 11 of the container main body 2 by the pressing head 75*a* of the capping means 75.

A pair of pressing levers 76 for pressing the middle of the drum body 10 of the container main body 2 from the sides to cause the surface of the viscous material 4 inside the container main body 2 to bulge is rotatably provided under the container main body 2. The pressing levers 76 are driven by an air cylinder 77 so as to open and close between th e open p position illustrated by the solid line in FIG. 17 and the pressed position indicated by the imaginary line. The pressing levers 76 should allow at least a part of the drum body 10 midway in the heightwise direction to be pressed, so that the drum body 10 is pressed in two or more locations, and possibly around the entire periphery. Although the locations where the drum body is pressed may be any position in the heightwise direction, the drum body is preferably pressed in the center for ease of operations. When a plurality of pressing levers 76 are provided, the locations in which the drum body is pressed may be offset in the heightwise direction, Symbol 78 is a support component that supports the holding clamps 66 of the clamper 65 from below to prevent excess weight from being exerted on the clamper during capping.

Heat sealing equipment, ultrasonic sealing equipment, high frequency induction sealing equipment or the like with a well known structure can be used as the fusion equipment. For example, when heat sealing equipment is used, a heating head may be held against the outer periphery of the lid member 3 to thermally fuse the lid member 3 to the entire periphery of the reinforcing ring 11 of the container main body 2 so as to fix the two together in an air-tight manner. When the lid member 3 and the reinforcing ring 11 are sealed in an air tight manner using sealing tape 7, means for applying sealing tape 7 between the lid member 3 and the reinforcing ring 11 may be used as an alternative to the fusion equipment. When the lid member 3 and reinforcing ring 11 are fixed in an air-tight manner using an adhesive, self-adhesive, or gasket, means are provided for applying a sealing means such as an adhesive or self-adhesive to the fitting component 14 of the reinforcing ring 11 and/or the ring-shaped groove 23 of the lid member 3 before the container main body 2 is capped with the lid member 3, or means are provided for the hot melt application of a thermoplastic hot melt composition, or means are provided for mounting a ring-shaped gasket. When the container is filled with an adhesive or self-adhesive as the viscous material 4, the pressure exerted on the drum body 10 by the pressing levers 76 can be adjusted so that some of the viscous material 4 charged into the container main body 2 is taken into the fitting component between the lid member 3 and the reinforcing ring 11.

The operation of the filling equipment 34 is described below while the met hod of r filling the container main body 2 with the viscous material 4 is described.

A container main body 2 which has been transferred from the transfer equipment 51 to the clamper 66 of the filling equipment 34 is moved while rotated at a 90° angle along with the rotating table 67 to the charging equipment. The container main body 2 is lifted along with the clamper 65 by the charging equipment as shown in FIGS. 18(*a*) and (*b*) to insert the viscous material feed tube 71 into the interior of the container main body 2, and the container main body 2 is lowered in alignment with the clamper 65 as the viscous material 4 is charged from the viscous material feed tube 71 so that only the necessary amount of the viscous material 4 is charged into the container main body 2 without any air bubbles being mixed into the viscous material 4. While the viscous material 4 is in this state, the surface of the viscous material 4 forms a peak with the center swelling up because of the viscous material 4.

The container main body 2 filled with the viscous material 4 is then moved while rotated 90° along with the rotating table 67 to the capping equipment 70. Then, as shown in FIGS. 18(*c*) and 19, the middle of the drum body 10 of the container main body 2 is pressed by the pressing levers 76 of the capping equipment 70 to cause the surface of the viscous material 4 to bulge, thus increasing the apparent amount of viscous material 4 charged therein. At this time, the surface of the viscous material 4 bulges in generally the same peaked shape that results from charging.

Figure 20:
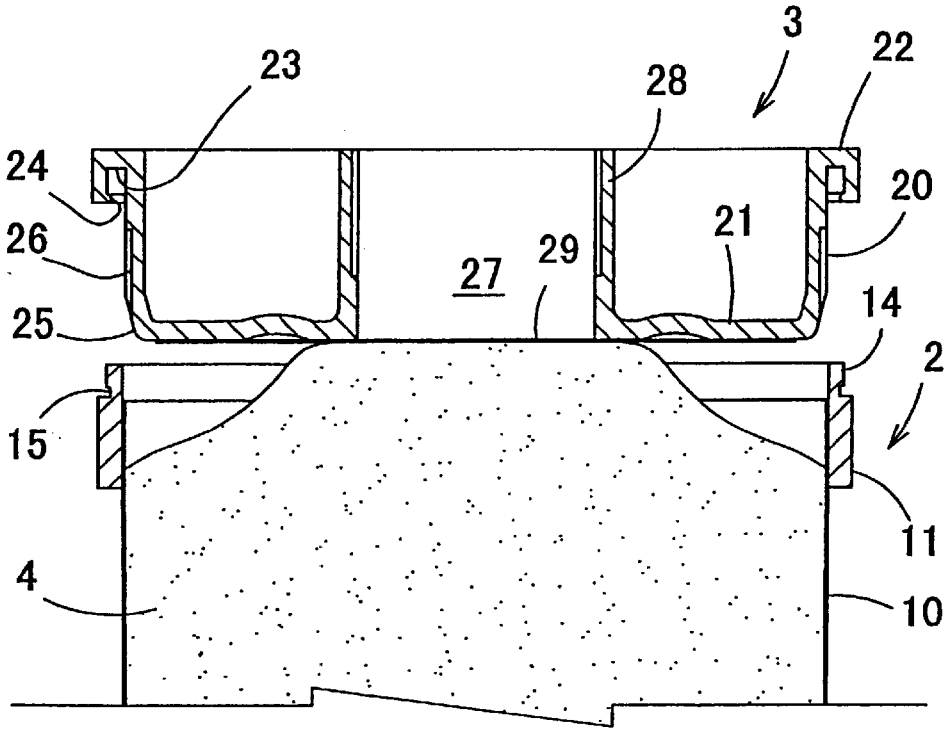
FIG. 20 is an illustration of the state midway through the process by which the container main body is capped with the lid member.
Figure 21:
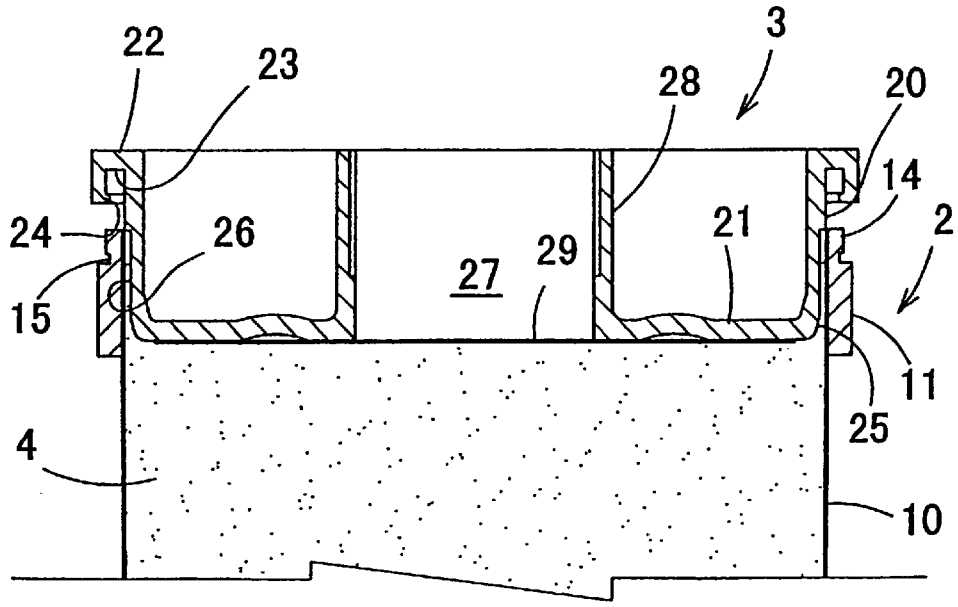
FIG. 21 is an illustration of the state midway through the process by which the container main body is capped with the lid member.
Figure 22:
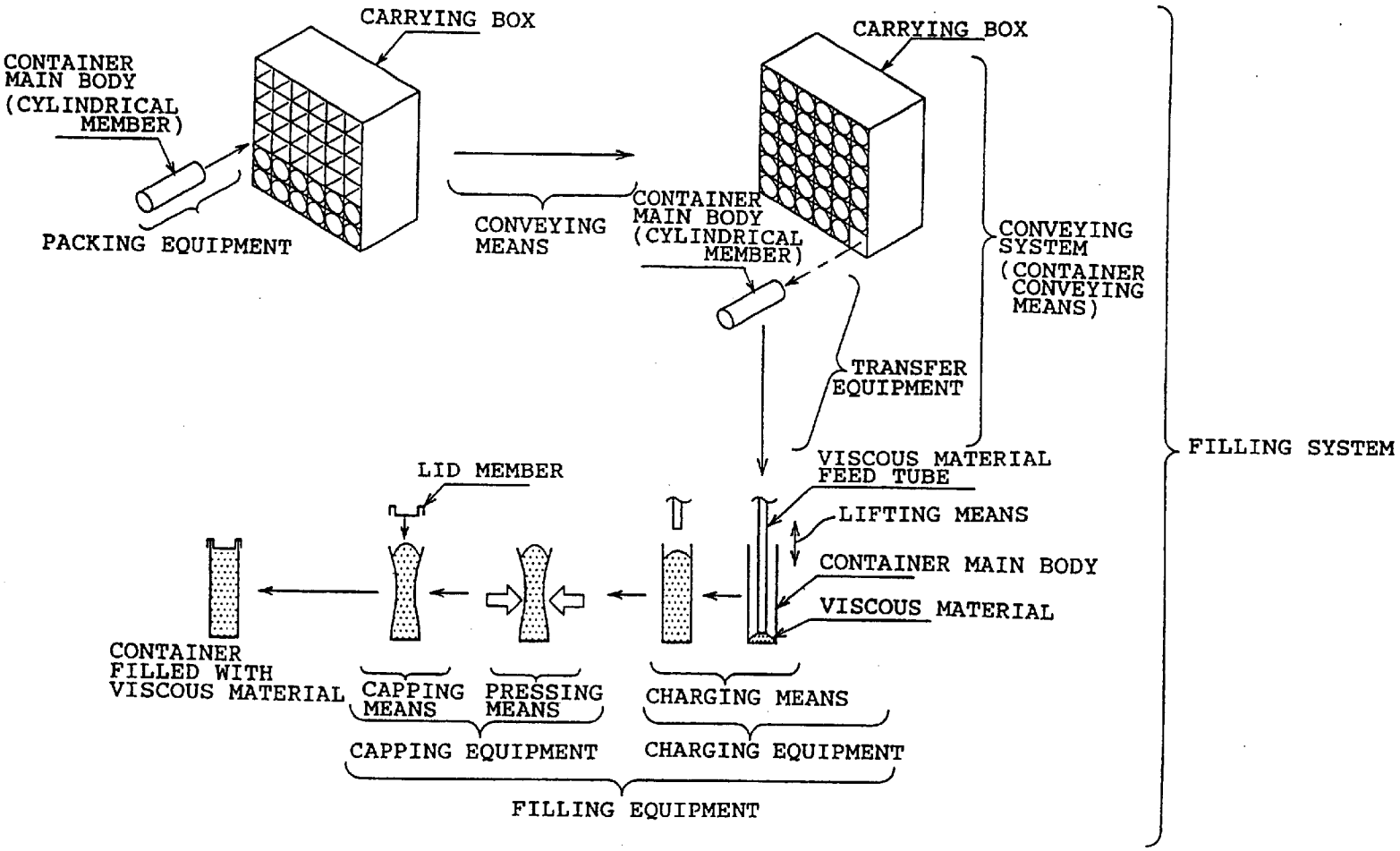
FIG. 22 is a schematic illustration of the present invention.
Figure 23:
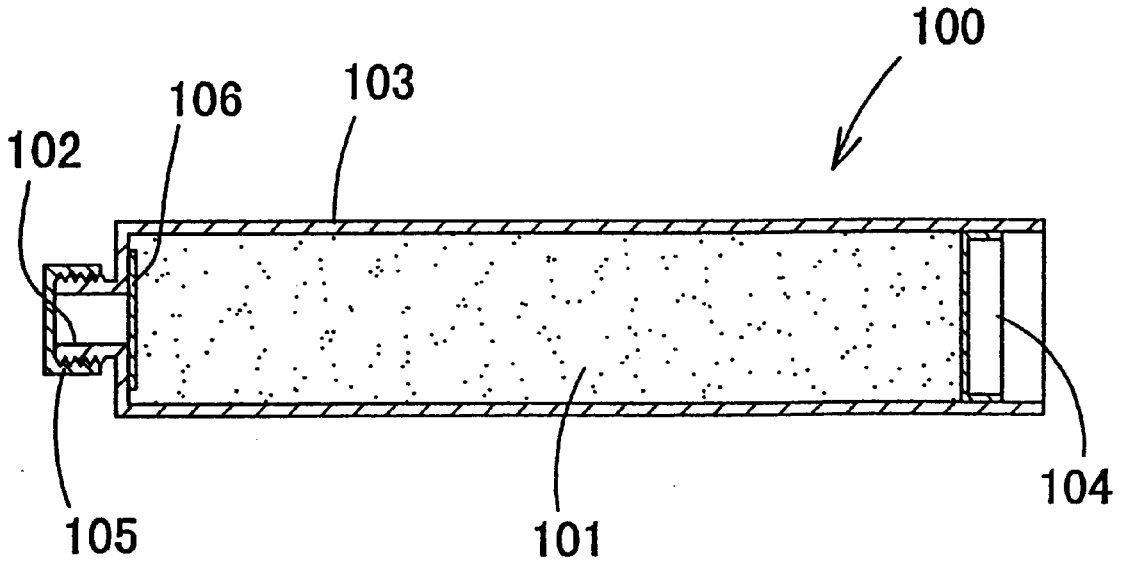
FIG. 23 is a vertical cross section of a filled container in the prior art.

The pressure by the pressing levers 76 is then released, the lid member 3 held by the holding component 73 is extended downward by the capping means 75, and the sliding cylinder 20 of the lid member 3 is inserted into the reinforcing ring 11 of the container main body 2 as shown in FIG. 18(*d*) as the drum body 10 returns to its original shape, but at this time the lid member 3 is in intimate contact with the apex of the surface of the viscous material 4, as shown in FIG. 20, and the air between the lid member 3 and the viscous material 4 is evacuated since the lid member is in intimate contact with the surface of the viscous material 4 as the apex of the surface of the viscous material is flattened out, that is, as the intimate contact between the surface and the lid member 3 widens outward. When the lid member 3 begins to be fitted into the reinforcing ring 11, virtually all the air is evacuated through a gas venting groove 26, and the lid member 3 is fitted to the reinforcing ring 11 as shown in FIG. 21. Even when the pressure on the drum body 10 by the pressing lever 76 is released, since the drum body 10 is a flexible film, the lid member 3 may be fitted to cap the container with greater force than the pressing force of the pressing lever 76.

At this time, the lid member 3 is pressed into the reinforcing ring 11 by the capping means 75, the fitting protrusion 14 of the reinforcing ring 11 is fitted to the ring-shaped groove 23 of the lid member 3 as shown in FIG. 3, and the protrusion 24 of the lid member 3 is fitted to the fitting groove 15 of the reinforcing ring 11.

After the container has been capped with the lid member 3, the outer periphery of the lid member 3 is fused to the reinforcing ring 11 to fix the lid member 3 to the reinforcing ring 11 in an air-tight manner. When the lid member 3 and reinforcing ring 11 are fixed in an air tight manner using a sealing agent such as an adhesive or self-adhesive, the sealing agent is applied in advance to the fitting protrusion 14 of the reinforcing ring 11 and/or ring-shaped groove 23 of the lid member 3. When the lid member 3 and reinforcing ring 11 are fixed in an air tight manner by means of the viscous material 4, the pressure on the drum body 10 is increased, so that the viscous material 4 is taken into the fitting components between the lid member 3 and reinforcing ring 11. When the components are sealed by means of sealing tape 7, the sealing tape 7 is applied between the lid member 3 and reinforcing ring 11 by means of a sealing tape 7 dispenser means provided as an alternative to a fusion means.

The filled container 1, comprising a container main body 2 that has been filled with a viscous material 4 and capped in this manner, is effectively prevented from having any air left over around the lid member 3, and the viscous material 4 therein is effectively prevented from deteriorating, hardening or curing as a result of left over air. Since, furthermore, the lid member 3 and reinforcing ring 11 can be sealed in an air-tight manner by fusion, a sealing agent, a gasket, sealing tape 7, or a combination thereof, the viscous material 4 can be effectively prevented from hardening or curing and the quality can be prevented from deteriorating as a result of external air penetrating through the slight gap between the lid member 3 and reinforcing ring 11. For example, even when the container is filled with a sealant consisting of a moisture-curing composition as the viscous material 4, the above structure can ensure that no moist air penetrates into the interior of the container main body, thereby preventing the viscous material from being cured by moist air.

In this example, the invention was applied to a system for filling container main bodies 2 with a viscous material 4 such as construction sealant or adhesives, but the invention is applicable to filling systems for viscous materials other than that used in construction, such as mayonnaise, jams, or other food products, provided that the material is used to fill cylindrical containers. The container main body can also be formed in a shape other than a cylindrical shape, provided that the drum body is made of a flexible film. Additionally, the structure of the filling system itself may vary, provided that the structure allows the drum body to be pressed in order to cause the surface of the viscous material to bulge during capping.

According to the filling system of the invention, a viscous material is charged by the charging means into the container main body, the drum body of the container main body is then pressed by the pressing means to cause the surface of the viscous material to bulge, and the opening of the reinforcing component of the container main bodies capped with a lid member by the capping means to allow the reinforcing component to be capped with the lid member in an air tight manner, thereby preventing air from being left over inside the container main body, as well as preventing the viscous material charged into the container main body from hardening, curing or undergoing deterioration in quality.

When the container conveying means further comprises a carrying box, the container main bodies can be conveyed while temporarily accommodated in the carrying box, thereby effectively preventing the container main bodies from being damaged during transport. It is thus possible to convey container main bodies, even those with a drum body made of a flexible film, while effectively preventing their deformation or the like during transport.

The container main bodies can be smoothly packed in the housing components of the carrying box when notches having a notch width narrowing in the depthwise direction are formed in the region including generally the center in at least the widthwise direction of the end on the open side of the dividing plates forming the housing components of the carrying box.

When the housing components are formed in a plurality of columns and rows in the carrying box the container main bodies are packed in the plurality of housing components in each column and row of the carrying box, or container main bodies which have been placed in a plurality of housing components in each row or column of the carrying box can be simultaneously taken out, thereby allowing the container main bodies to be transferred more efficiently with the carrying box.

When the lid member is fitted to the opening of the reinforcing component of the container main body as the drum body is allowed to return to its original shape after the drum body of the container main body has been temporarily pressed and then released by a capping means, the drum body of the container main body can be allowed to naturally return to its original shape in conjunction with the action of the lid member being fitted to the opening of the reinforcing component of the container main body, so that the lid member is fitted to the opening without leaving any air, and the container main body is capped in an air-tight manner.

When, in order to allow the viscous material to be charged into the container main body by the charging means, a viscous material feed tube is first inserted into the interior of the container main body, and the viscous material is discharged from the viscous material feed tube to charge the viscous material into the container main body as the viscous material feed tube is moved in a direction away from the container main body, air is effectively prevented from being mixed into the viscous material and is prevented from being left over between the container main body and the viscous material.

The system for conveying cylindrical members allows the cylindrical members to be effectively prevented from becoming damaged during transport because the cylindrical members serving as the container main bodies are conveyed while temporarily accommodated in the carrying box. It is thus possible to effectively prevent damage, deformation, and the like during transport, even when the drum body of the cylindrical members is made of a flexible film.

When the notched component of the dividing plates is formed at the open end of the dividing plates forming the housing components, the end of the cylindrical member is guided at the inserted end into the notch, and the cylindrical member is smoothly accommodated in the housing component, even when the axis of the cylindrical member is slightly offset relative to the center of the housing components when the cylindrical members are being packed, thereby preventing the inconvenience of damage to the cylindrical members while also affording greater operating efficiency.

Packing efficiency can be improved when housing components are formed in a plurality of columns and rows in the carrying box, and the cylindrical members are packed in the plurality of housing components in each column and row of the carrying box as the carrying box is moved a column or row at a time by the packing equipment.

The conveyance and transfer of cylindrical members can be automated by providing transfer equipment for taking the cylindrical members out of the carrying box and transferring them.

When the transfer equipment is provided with an expanding head, the cylindrical members can be held from the inside by the expanding head and transferred to the next process, thereby minimizing the positional displacement of the cylindrical members during transfer. The cylindrical members can be reliably held and transferred when the expanding head is formed in the shape of a cylindrical member, even when the cylindrical member is made of a flexible film.

When the cylindrical members are taken out of the housing components and transferred while vertically oriented by the transfer equipment, the orientation of the cylindrical members can be changed to a more easily manipulated orientation to more efficiently carry out various operations such as processing, filling the containers with viscous material, etc. Specifically, the viscous material can be charged into container main bodies in the form of cylindrical members, and the container main bodies can be supplied to the filling equipment to be capped.

According to the viscous material filling system of the invention, the drum body of the container main body can be made of a flexible film, yet the container main bodies can be packed into the housing components of the carrying box and conveyed, thereby preventing the inconvenience of damage or deformation of the drum body of the container main body during transport. It is thus possible to automate the conveyance of the container main bodies as well as the series of operations involving the charging of the viscous material into the container main bodies and capping the containers with lid members, and to more efficiently produce container main bodies filled with a viscous material.

According to the viscous material filling system, the container main bodies are packed in the housing components of the carrying box and conveyed, making it possible to prevent the inconvenience of the drum body of the container main bodies becoming damaged or deformed during transport, as well as automating the conveyance of the container main bodies as well as the series of operations involving the charging of the viscous material into the container main bodies and capping the containers with lid members, and more efficiently producing containers filled with a viscous material. In addition, the container main bodies conveyed by the carrying box are transferred, while vertically oriented, to the filling equipment by the transfer equipment of the conveying system, making it possible for the viscous material to be charged by the filling equipment into the container main bodies in the vertical orientation in which they are transferred, allowing the container main body to be capped with lid members, and resulting in the smoother transfer of the container main bodies. The container main bodies can be transferred by the transfer equipment while held from the inside of the container main bodies, making it possible to prevent inconveniences such as deformation of, or damage to, the drum body of the container body during transport.

When the filling equipment is provided with a moving means having a rotating table and support means, the container main bodies which have been changed by the transfer equipment to a vertical orientation are held at the rigid reinforcing component by means of the clamper and thus transferred to the filling equipment, allowing the container main bodies to be smoothly transferred and the transferred container main bodies to be held with greater precision by the support means of the filling equipment. The container main bodies are moved along with a rotating table, they are filled with viscous material by the charging equipment while held sequentially by the clamper, and they are capped with lid members by the capping equipment, thereby allowing the viscous material charging and lid member capping operations of the container main bodies to be carried out more efficiently.

When the capping equipment is provided with a pressing means and the containers are capped with lid members while the surface of the viscous material is bulging, the lid member can be secured in an air tight manner to the reinforcing component without any air left over in the container main body and without any of the viscous material leaking to the outside.

When the openings of the container main bodies are capped with the lid members as the drum bodies are allowed to return to their original shape after the drum body has been temporarily pressed by the pressing means and released, the drum body can be pressed with simple control while preventing any air from being left inside the container main bodies.

When the charging equipment comprises a viscous material feed tube and a lifting means, it is possible to effectively prevent air from being mixed into the viscous material and air from being left over between the container main body and the viscous material when the viscous material is charged into the container main bodies.

According to the viscous material filling method, the viscous material is charged into the container main bodies, the drum body of the container main body is then pressed to cause the surface of the viscous material to bulge, the lid member is then fitted to the opening of the reinforcing component of the container main body, and the lid member is secured in an air tight manner to the reinforcing component, thereby preventing air from being left over inside the container main body, while also preventing the viscous material charged into the container main body from hardening, curing or the quality from deteriorating.

When a lid member is fitted to the opening of the reinforcing component of a container main body while the drum body is allowed to return to its original shape after the drum body of the container main body has been temporarily pressed and then released, the drum body of the container main body can be allowed to return to its original shape naturally in conjunction with the action of the lid member being fitted to the reinforcing component.

It is also possible to effectively prevent air from being mixed into the viscous material and to prevent air from being left over between the container main body and the viscous material while the viscous material is charged in when the viscous material feed tube is first inserted into the interior of the container main body and the viscous material is discharged from the viscous material feed tube to charge the viscous material as the viscous material feed tube is moved in a direction away from the container main body in order to charge the viscous material into the container main body.

When the lid member is fitted to the opening of the reinforcing component of the container main body, and the lid member and the reinforcing component are then secured in an air tight manner by means of at least one of fusion (melting), a sealing agent, a gasket, or sealing tape, it is possible to create an air-tight seal between the lid member and the reinforcing component, to prevent air from penetrating through the slight gap between the two, and to prevent the viscous material from hardening, curing or the quality from deteriorating.

According to the viscous material filling equipment of the invention, a rigid reinforcing component is held by means of the support means to vertically support the container main body, allowing the container main body to be held in a reliable manner. The drum body is pressed by the pressing means to cause the surface of the viscous material to bulge, and the lid member can be fitted to the opening of the reinforcing component of the container main body in that state, thereby effectively preventing air from being left over in the container main body and also allowing the lid member to be secured in an air-tight manner to the reinforcing component of the container main body to seal the viscous material inside the container main body while preventing the viscous material from leaking out of the container main body.

When the drum body is temporarily pressed by the pressing means and then released, and the container main body is capped with the lid member by the capping means as the drum body returns to its original shape, the drum body of the container main body is allowed to naturally return to its original shape in conjunction with the action of the lid member being fitted to the opening of the reinforcing component, so as to seal the viscous material inside the container main body without any air being left over.

When the charging means further comprises a viscous material feed tube having a length insertable into at least the interior of the container main body, and lifting means for lifting the viscous material feed tube relative to the container main body, air is effectively prevented from being mixed into the viscous material or air is effectively prevented from being left over between the container main body and the viscous material as the viscous material is charged into the container main body when the viscous material feed tube is inserted into the container main body by the lifting means and the viscous material is then charged into the container main body as the viscous material feed tube is taken out of the container main body.

According to the container filled with a viscous material, the drum body of the container main body is made of a flexible film, so that the viscous material is extruded and discharged from the container main body as the drum body is squeezed, and the used filling container can be squeezed into a smaller size, thereby reducing the volume of waste.

Since the lid member is also secured to the reinforcing component integrally provided with the container main body, without any displacement in the positional relationship between the lid member and reinforcing component, an air-tight seal can be created between the two. Furthermore, the drum body of the container main body can be pressed to cause the viscous material to bulge, and the lid member can be fitted to the opening of the reinforcing component of the container main body in that state, effectively preventing air from being left inside the container main body, and also allowing the viscous material to be sealed inside the container main body while preventing the viscous material from leaking out of the container main body.

When the lid member is fixed by means of at least one of fusion, a sealing agent, a gasket, or sealing tape to the reinforcing component, an air-tight seal can be created between the lid member and the reinforcing ring, thereby effectively preventing the viscous material from hardening, curing or the quality from deteriorating as a result of outside air penetrating into the container main body.

What is claimed is:

1. Viscous material filling equipment, comprising:

support means whereby a container main body with at least a drum body consisting of a flexible film and an open end consisting of a rigid reinforcing component is vertically held at the reinforcing component, with the opening on top;

charging means for charging the viscous material into the vertically held container main body;

pressing means for pressing the drum body of the container main body filled with a viscous material to cause the surface of the viscous material to bulge;

a lid member supply means for supplying a lid member over the container main body in which the surface of the viscous material is bulging; and capping means for fitting the lid member to the opening of the reinforcing component of the container main body and fixing the lid member in an air-tight manner to the reinforcing component.

2. Viscous material filling equipment according to claim 1 wherein the drum body is temporarily pressed by the pressing means and then released, and the container main body is capped with the lid member by the capping means as the drum body returns to its original shape.

3. Viscous material filling equipment according to claim 1 or 2, the charging means further comprising a viscous material feed tube having a length insertable into at least the interior of the container main body, and lifting means for lifting the viscous material feed tube relative to the container main body, wherein the viscous material feed tube is inserted by the lifting means into the interior of the container main body, and the viscous material is charged into the container main body as the viscous material feed tube is pulled out of the container main body.

* * * * *